US006568898B2

(12) United States Patent
Nishimura et al.

(10) Patent No.: US 6,568,898 B2
(45) Date of Patent: May 27, 2003

(54) HYDRAULIC SHOVEL WITH HOISTING HOOK

(75) Inventors: Satoru Nishimura, Osaka (JP); Takumi Nagahara, Osaka (JP)

(73) Assignee: Komatsu Limited, Tokyo (JP)

( * ) Notice: Subject to any disclaimer, the term of this patent is extended or adjusted under 35 U.S.C. 154(b) by 72 days.

(21) Appl. No.: 09/865,036

(22) Filed: May 24, 2001

(65) Prior Publication Data

US 2001/0046433 A1 Nov. 29, 2001

(30) Foreign Application Priority Data

May 26, 2000 (JP) ..... 2000-156140
Jun. 2, 2000 (JP) ..... 2000-165783

(51) Int. Cl.[7] ..... E02F 3/30
(52) U.S. Cl. ..... 414/699; 414/694; 414/912
(58) Field of Search ..... 414/694, 699, 414/912; 212/250

(56) References Cited

U.S. PATENT DOCUMENTS 4,561,199 A * 12/1985 Lockwood ..... 414/912 X
4,790,084 A * 12/1988 Anderson et al. ..... 414/912 X
5,488,787 A * 2/1996 Aoyagi et al. ..... 414/699 X

FOREIGN PATENT DOCUMENTS

JP 60-70234 * 4/1985 ..... 414/699
JP 10-317432 12/1998
JP 11-209074 8/1999

* cited by examiner

*Primary Examiner*—Donald W. Underwood
(74) *Attorney, Agent, or Firm*—Bell, Boyd & Lloyd LLC

(57) ABSTRACT

A hoisting hook is arranged on a stick boom top pin for attaching a bucket to a distal end of a stick boom and hung at a bucket scooping face side. A bucket fall prevention valve is provided at least on a head side of a bucket cylinder for maintaining the cylinder inner pressure in order to prevent the bucket from free fall. A crane work by the hoisting hook is performed with the bucket dumped to the stick boom back side to the maximum extent. During the crane work, even if the hydraulic oil hose connected to the bottom side of the oil chamber of the hold pressure generation side of the bucket cylinder is broken by an external force, the bucket fall prevention valve acts instantaneously, cuts off the head side oil chamber from the exterior oil passage completely, and maintains the hold pressure of the head side oil chamber, so that the bucket is prevented from rotating suddenly downward. There is provided a hydraulic shovel allowing to perform a good crane work with an improved visibility of an operator, the bucket is prevented from free fall due to the lifted load, by securing the bucket cylinder hold force, and the crane work safety is improved.

6 Claims, 10 Drawing Sheets

HYDRAULIC SHOVEL WITH HOISTING HOOK

BACKGROUND OF THE INVENTION

1. Field of the Invention

The present invention relates to a hydraulic shovel provided with main boom, stick boom, bucket or other operation machine and, especially, to a hydraulic shovel ensuring the operation efficiency or the security during the crane work using a hoisting hook.

2. Description of the Related Art

Conventionally, the hydraulic shovel has been used for earth and sand excavation, transportation or various other operations. A hydraulic shovel 1' shown in FIG. 12 comprises a travel body 2', a revolving frame 3' mounted on the travel body 2' to be rotatable about the vertical axis, and an operation machine 4' fitted to the revolving frame 3'. The operation machine 4' comprises a main boom 6' vertically rising and descending by a not shown main boom cylinder attached substantially to the center of the revolving frame 3', a stick boom 8' vertically swinging by a not shown stick boom cylinder attached to the main boom 6' taking the distal end of the main boom 6' as fulcrum, and a bucket 11' vertically swinging by a not shown bucket cylinder attached to the stick boom 8' through a pair of right and left links 10' taking the distal end of the stick boom 8' as fulcrum.

In addition to a not shown engine loaded near the rear section of the revolving frame 3', a variable capacity type pump (not shown also) driven by the engine, and a plurality of command valves (not shown also) driving a plurality of operation cylinders of the operation machine 4' by selectively supplying hydraulic oil discharged from the variable capacity type pump are provided. The command valve is connected in correspondence to the operation cylinder of the operation machine 4'. A plurality of not shown command levers for changing over independently the plurality of command valves are disposed in an operator cabin 3*a'* disposed at a position shifted to the right or to the left from the front center of the revolving frame 3'.

A bottom section of the main boom cylinder is attached to the revolving frame 3', and a piston rod thereof is attached to the main boom, and the main boom 6' vertically rises and descends by this main boom cylinder. A bottom section of the stick boom cylinder is attached to the main boom 6', and a piston rod thereof is attached to the stick boom 8'. The stick boom 8' swings vertically by the stick boom cylinder taking the distal end of the main boom 6' as fulcrum. A bottom section of the bucket cylinder is attached to the stick boom 8', and a piston rod thereof is attached to the link 10' between the stick boom 8' and the bucket 11', and the bucket 11' vertically swings by the bucket cylinder attached by means of the pair of right and left links 10'. The hydraulic shovel 1' excavates the ground surface to a desired depth, transports excavated earth and sand to the dumping position and dumps the same.

On the other hand, there is a hydraulic shovel 1' capable of crane work in addition to earth and sand excavation, transportation and the like. This kind of hydraulic shovel has, as shown in FIG. 12, a hoisting hook 12' for lifting/hanging a load, fixed swingably to the back face side of the stick boom 8' through a link attachment fixing pin 11*b'* of the bucket 11', and provides the distal end of the stick boom 8' with a crane function. In order to prevent the bucket 11' and the hoisting hook 12' from interfering during the crane work, the bucket cylinder is extended to the maximum excavation position of the bucket 11', stopped at a state where the scooping face side of the bucket 11' is most retracted to the stick boom 8' side, and the crane work is performed by the hoisting hook 12' with this stopped posture.

In addition, a hydraulic shovel provided with another crane mechanism is disclosed, for example, in Japanese Utility Model Publication No. 58-11826. According to the hydraulic shovel disclosed in this Publication, a pair of winches are provided on the back of a main boom. A pair of first pulleys are supported by an stick boom support shaft for supporting rotatably the distal end of the main boom and a stock boom, while a pair of second pulleys are supported by the stick boom top pin. Two wires of respective winch are led inside the main boom and stick boom, wound around respective first and second pulleys, wound around a pair of third pulleys supported by a bracket of the hoisting hook, and the distal end of the wire is fixed to the stick boom. The hoisting hook is hung and supported at the stick boom bottom side through the wire, and the hoisting hook moves vertically by taking in/out the wire by the winch.

In order to prevent the bucket and the hoisting hook from interfering during the crane work, the bucket cylinder is retracted to the maximum dumping position of the bucket while being maintained at a posture where the bucket is most damped to the stick boom back side, and the crane work is performed by the hoisting hook with this posture. When the hoisting hook is not in use, the hoisting hook is hung and engaged by a hanging bar disposed inside a forked section of the stick boom by taking up the wire by the winch, and the hoisting hook is housed in the stick boom forked section.

During excavation or transportation of earth and sand, with the hoisting hook housed, the main boom cylinder and stick boom cylinder are operated to swing vertically the main boom and stick boom respectively and, at the same time, the bucket cylinder is operated for nodding the bucket vertically at the distal end of the stick boom. The hydraulic shovel excavates the ground surface to a desired depth, transports excavated earth and sand to the dumping position and dumps the same.

Generally, the conventional hydraulic shovel operates the main boom in the rising direction by elongating the main boom cylinder, and operates the main boom in the descending direction by retracting the same. Even when the main boom is erected, as the gravity center of the operation machine comprising main boom, stick boom and bucket is positioned forward of the equipment, an effort in the retraction directing for descending the main boom is applied to the main boom cylinder, thereby generating a hold pressure at the bottom side thereof at all times. Therefore, if a hydraulic oil hose connected to the main boom cylinder bottom side is broken by an external force, the hold force by the main boom cylinder is lost, and the main boom swings suddenly in the descending direction. Ordinarily, a fall prevention valve maintaining the inner pressure of the bottom side of the main boom cylinder is fitted in order to avoid this sudden swinging.

Moreover, the hydraulic shovel swings the stick boom downward by elongating the stick boom cylinder taking a linkage section with the main boom as fulcrum, and swings the stick boom upward by retraction operation. For example, during the transition from excavation to dumping operation, if a hydraulic oil hose connected to an oil chamber in the head side of the stick boom cylinder is broken by an external force, the hold pressure by the stick boom cylinder is lost, and the stick boom swings suddenly downward with the bucket. It is a common practice that a fall prevention valve is fitted to the head side of the stick boom cylinder in order to avoid this sudden swinging.

During the excavation of earth and sand, the main boom cylinder and stick boom cylinder are operated to swing the main boom and stick boom up and down respectively, and at the same time, the bucket cylinder is operated to nod the bucket at the distal end of the stick boom. An operation range of the distal end of the stick boom section of this time is within a rotation range from the vertical posture of the stick boom as it swings downward, to a swinging upper limit position of the equipment forward side, and a force in the retraction direction is always applied to the bucket cylinder and a hold pressure is generated at the bottom side, because the bucket cylinder is extended during the excavation.

During the transportation of excavated earth and sand to the dumping position, the bucket cylinder is extended, and it transports to the dumping position with the bucket retracted to the stick boom side and stopped (maximum excavation posture). In this case, due to the upper swing of the stick boom, the hold pressure becomes maximum at the beginning of transportation, and decreases gradually as it approaches the dumping position.

During the excavation, for example, if a hydraulic oil hose connected to an oil chamber in the bottom side of the bucket is broken by an external force, as falling of the bucket does not occur, it is unnecessary to provide a fall prevention valve. Even if the hydraulic oil hose is broken during the transport to the dumping position, at most earth and sand in the bucket fall, hardly affecting the periphery. Therefore, ordinarily, it is unnecessary to provide a rotation prevention valve in the oil chamber of the bucket cylinder bottom side.

On the contrary, during the dumping, as the bucket cylinder is operated to the retraction direction, the weight of the bucket and the weight of earth and sand generate hold pressure at the head side. At this time, for example, if a hydraulic oil hose connected to an oil chamber in the head side of the bucket cylinder is broken by an external force, the hold pressure of the bucket cylinder is lost all of a sudden, and the bucket swings suddenly downward, and may damage equipment and the like in the periphery.

Concerning the operation range of the distal end of the stick boom section for lifting a load also, as mentioned above, the hydraulic shovel stick boom is limited within the rotation range from the vertical posture to the swinging upper limit position at the equipment forward side. Therefore, as in the excavation or transportation operation, a hold pressure is always generated at the stick boom cylinder head side during the crane work.

At the dumping position, the weight of the bucket generates a hold pressure at the head side, as the bucket cylinder is operated toward the retraction, during the transition of the bucket maximum excavation posture to the dumping posture. For example, if the hydraulic oil hose connected to the oil chamber in the head side of the bucket cylinder is broken by an external force, the hold force of the bucket cylinder is lost instantaneously, and the bucket rotates suddenly downward. However, the conventional bucket cylinder is not provided with a rotation prevention valve for avoiding such a sudden swinging.

In the aforementioned type of hydraulic shovel provided with a cane function as shown in FIG. 12, as for the operation range of the distal end of the stick boom section for lifting a load, as mentioned above, the stick boom of the hydraulic shovel is limited within the rotation range from the vertical posture to the swinging upper limit position at the equipment forward side. Therefore, as in the excavation or transportation operation, a hold pressure is always generated at the stick boom cylinder head side during the crane work.

When a load is being lifted within the rotation range from the stick boom vertical posture to the swinging upper limit position at the equipment forward side, as the stick boom swings upward by operating the stick boom cylinder in the retraction direction, for example, if the hydraulic oil hose connected to the oil chamber in the head side of the stick boom cylinder is broken by an external force, the hold pressure of the stick boom cylinder head side is lost instantaneously, and the stick boom rotates suddenly downward. Accordingly, the lifted load swings largely taking the distal end of the stick boom as fulcrum. A rotation prevention valve fitted to the aforementioned stick boom cylinder head side prevents such event from occurring.

When a load is lifted, especially in the case that the hoisting hook is provided on the back side of the stick boom, in order to prevent the bucket and the hoisting wire from interfering, the bucket cylinder is extended to its extension limit to hold the bucket at its most retracted position. As a result, the maximum hold pressure is generated at the bucket cylinder bottom side.

When the hydraulic oil hose connected to the oil chamber in the bucket cylinder bottom side is broken, also, the bottom side hold force is lost instantaneously as for the stick boom, and the bucket rotates suddenly downward. However, the bucket cylinder is not provided with a rotation prevention valve for avoiding such a sudden swinging.

If the crane work, excavation or other operation can be performed with the stick boom rotated up to a front immediate proximity position of the equipment, the operation can be performed before the operator's eyes, and it is further preferable in respect of the operation efficiency. However, in the state of art, it is difficult to improve the operation efficiency, because the stick boom can not move to the front immediate proximity position of the equipment, as the stick boom rotation from upward to downward is limited forward than the position corresponding the stick boom vertical posture. In addition, when a load is to be lifted, the hoisting hook is obliged to move within the stick boom rotation range, as the stick boom rotation range is limited. As a result, the crane work is performed at the position far from the equipment because the stick boom rotation range is limited, deteriorating the crane work efficiency remarkably.

Beside, when the crane work is to be performed by the hydraulic shovel provided with crane function disclosed in the aforementioned Publication, in order to prevent the bucket and the lifting wire from interfering, the bucket cylinder is retracted to its retraction limit to hold the bucket at its most dumped position. As a result, the maximum hold pressure is generated at the bucket cylinder head side.

In the state where this bucket dumping position is maintained, for example, if the hydraulic oil hose connected to the oil chamber in the head side of the bucket cylinder is broken, the hold pressure of the bucket cylinder head side is lost instantaneously, and the bucket rotates freely downward, applies a large impact to the lifting wire, if a load is being lifted, and may damage or cut the wire. As the result, the hoisting hook or the wire with its load swing largely or fall.

In addition, the distal end of the stick boom disclosed in the aforementioned Publication, supports rotatably one end of each of a pair of landcells of the bucket by a stick boom top pin provided inside the forked section separated right and left and, at the same time, hangs the hoisting hook through two wires wound around a pair of second pulleys provided on the stick boom top pin. Consequently, the distal end of the stick boom section should be strong enough to resist the weight of hoisting hook itself, the load weight or others. Moreover, it is preferable to house the hoisting hook without requiring manual work during the transition from crane work to excavation operation.

SUMMARY OF THE INVENTION

The present invention has been achieved in view of these conventional problems. An object of the invention is to provide a hydraulic shovel allowing to prevent a stick boom and a bucket from free fall, by ensuring a hold force of a stick boom cylinder and a bucket cylinder, to enlarge the operation range of an operation machine.

The stick boom downward rotation limit is restricted to the position of its vertical posture, because, when the stick boom rotates to the equipment front immediate proximity position, the stick boom rotates downward to the vertical posture position, thereafter, rotates forward and upward, and at this time also, it becomes necessary to maintain the hold pressure at the cylinder bottom side. However, in the state of art, the stick boom cylinder hold pressure is secured only at the head side.

It is preferable that the hydraulic shovel provided with crane function can be operated at the equipment immediate proximity position not only during the excavation or transportation, but also during the crane work and, therefore, it is desirable to provide the corresponding oil chamber side with rotation prevention means of main boom, stick boom and bucket, so as to maintain the hold pressure securely, even when the maximum hold pressure is applied to respective cylinders of main boom, stick boom and bucket and, at the same time, to maintain the hold pressure thereof, even when the hydraulic oil hose is broken.

The present invention provodes a hydraulic shovel, comprising a main boom rising and descending on a revolving frame, a stick boom linked to the distal end of the main boom and swinging in a vertical direction, and a bucket attached to the distal end of the stick boom and swinging similarly in the vertical direction, wherein the main boom, the stick boom and the bucket are respectively operated independently by operation cylinders; and stick boom rotation prevention means for preventing the stick boom from free fall by maintaining a bottom side hold pressure is provided on a bottom side of the cylinder for the stick boom.

The stick boom cylinder extends until the stick boom rotates downward and attain the vertical position, and at this time, the stick boom hold pressure is always generated at the stick boom cylinder head side. Therefore, conventionally, the rotation prevention valve has been fitted to the stick boom cylinder head side. However, in excavation work or crane work, when the stick boom rotates from the vertical posture to the rotation upper limit position at the equipment rear side, the stick boom cylinder continues to extend and, at the same time, the stick boom hold pressure shifts to the bottom side. Consequently, it is necessary to provide the stick boom cylinder bottom side also with rotation prevention means as the head side as the case of the present invention, in order to rotate the stick boom to the equipment rear side rotation upper limit position and hold the same.

In the present invention, the stick boom rotation prevention means is directly fixed to the bottom side of stick boom cylinder, and even if the hydraulic oil hose connected to the stick boom cylinder bottom side is broken and the bottom side hydraulic pressure is lost during the rotation of the stick boom toward the rotation upper limit position at the equipment rear side, the stick boom rotation prevention means cuts off the cylinder bottom side oil chamber from the exterior oil passage, and maintains the hold pressure of the bottom side oil chamber.

In addition, for example, detecting the rupture of the hydraulic oil hose or the like connected to the bottom side oil chamber, during the operation of a command valve, the command valve may be returned automatically to the non-operation position and, in this case also, the stick boom rotation prevention means maintains securely the bottom side hold pressure, and supply and discharge of the hydraulic oil stop automatically.

The aforementioned composition makes unnecessary to set the stick boom limit operation range as in the prior art, and allows to rotate freely within the equipment forward side and equipment backward side rotation limits including the stick boom vertical posture by the operation of the stick boom cylinder. As a result, the safety is secured, the operation range can be extended, allowing to perform an effective earth and sand excavation and transportation work.

If the rotation prevention means is provided both at the head side and bottom side of the stick boom cylinder, a sudden downward rotation of the stick boom can be prevented, because hold pressure in the cylinder extension direction and retraction direction by the load of the stick boom and excavated earth and sand or the like is supported instantaneously by the rotation prevention means, and the safety can be secured in the extended whole operation range.

On the other hand, when excavated earth and sand are transported to the dumping position, the bucket cylinder is extended, and the bucket is maintained at the maximum excavation posture where the bucket is stopped at the state retracted to the stick boom lower face side. In this case, a force in the cylinder retraction direction is always applied to the bucket and generates a hold pressure at the bucket cylinder bottom side. At this dumping position, the stick boom cylinder is retracted to rotates the stick boom upwards and, at the same time, the bucket cylinder is retracted to shift the bucket from the maximum excavation posture to the maximum dumping posture. In this dumping posture, an extension force is always applied to the bucket cylinder and generates a hold pressure at the bucket cylinder head side.

According to the present invention, similarly as the aforementioned stick boom, it is preferable to fix bucket rotation prevention means directly to the bottom side of a desired cylinder oil chamber, for enabling to support a force in the cylinder extension direction or retraction direction applied by the bucket own weight or the like and, in addition, to prevent the bucket from falling rapidly.

For example, during earth and sand excavation and transportation, the stick boom is rotated vertically not only in the equipment forward side operation range, but also in the whole rotation range including the equipment backward side, and at the same time, the bucket is made to nod vertically by the operation of the bucket cylinder. The aforementioned composition increases the stick boom rotation range compared to the case where the operation is performed only within the rotation range of a stick boom rotating from the vertical posture to the equipment forward side as in the prior art and, in addition, enlarges the bucket excavation rotation range, and increases the excavation range thereof. At the same time, in addition to the functional effect as mentioned before, securer and more effective earth and sand excavation and transportation can be performed, and moreover, the work safety can be enhanced.

Further, in the present invention, bucket rotation prevention means for preventing the bucket from free fall by maintaining the head side hold pressure when the bucket cylinder is retracted is preferably provided at least on the head side of the bucket cylinder.

As the hydraulic shovel disclosed in the aforementioned Publication, the hoisting hook is provided at the stick boom top pin for attaching the bucket and stick boom, and hung from the distal end of the stick boom section. During the crane work, in order to prevent the bucket and the hoisting hook from interfering, the aforementioned bucket cylinder is required to retract to the state where the bucket is most dumped to the stick boom back side (maximum dump position). In this case, the crane work is performed by the hoisting hook with the scooping face side of the bucket faced downward. When the load is lifted, a force in the cylinder extension direction is always applied to the bucket and the maximum hold pressure is generated at the bucket cylinder head side in almost all areas in the rotation range of its main boom and stick boom.

In the present invention, as bucket fall prevention means is directly fitted at least to the head side of the bucket cylinder, even if the hydraulic oil hose connected to the oil chamber in the head side of the bucket cylinder is broken during the crane work, the bucket fall prevention means acts instantaneously, cuts off completely the head side oil chamber from the exterior oil passage, maintains securely the hold pressure of the head side, and prevents the bucket from swinging suddenly downward.

In addition, for example, detecting the rupture of the hydraulic oil hose connected to the bucket cylinder head side, during the operation of the command valve, the command valve may be returned automatically to the non operation position. In this case also, the bucket fall prevention means maintains securely the head side hold pressure, and the hydraulic oil supply and discharge stop automatically.

The hoisting hook is disposed at the stick boom top pin for attaching bucket and stick boom, and hung from the distal end of the stick boom section. During the crane work, the bucket is set in the dumping posture allowing the operator to watch the hook with his/her eyes, and to perform the crane work effectively and safely, without being obstructed to look forward by the bucket.

On the other hand, during earth and sand excavation, the stick boom is rotated vertically by the operation of the stick boom cylinder head side, and at the same time, the bucket is made to nod vertically by the operation of the bucket cylinder. If the bucket fall prevention means is provided both at the head side and bottom side of the bucket cylinder, during the operation at the dump position with the bucket cylinder retracted, or during the operation at the excavation position with the bucket cylinder extended, even if the hydraulic oil hose connected to the hold pressure generation side of the bucket cylinder is broken, the bucket fall prevention means closes the inside of the cylinder completely, and maintains the maximum hold pressure of the bucket cylinder, enabling to support a hold pressure in the cylinder extension direction or retraction direction applied by the bucket own weight, the load of excavated earth and sand or the like, to prevent securely the bucket from falling rapidly, and to enhance the work safety.

For example, during transportation of excavated earth and sand excavation, the bucket cylinder is extended, and the bucket is maintained in its maximum excavation posture where the bucket is stopped at the state retracted to the stick boom under face side. In this case, a force in the cylinder retraction direction is always applied to the bucket and the maximum hold pressure is generated at the bucket cylinder bottom side. At this dump position, the stick boom is rotated upward by retracting the stick boom cylinder, and at the same time, the bucket is shifted from the maximum excavation posture to the maximum dumping posture by retracting the bucket cylinder. In this dumping posture, a force in the extension direction is always applied to the bucket cylinder, generating a hold pressure at the bucket cylinder head side.

When the bucket is shifted from the maximum excavation posture to the maximum dumping posture, even if the hydraulic oil hose connected to the head side of the bucket cylinder is broken, the bucket fall prevention means closes inside of the cylinder completely, and maintains the maximum hold pressure of the bucket cylinder, enabling to support the force in the cylinder extension direction, to prevent securely the bucket from rotating downward suddenly, and to enhance the work safety.

Preferably, in addition to the bucket cylinder, stick boom fall prevention means for preventing the stick boom from freely rotating downward by maintaining a bottom side hold pressure is provided on a bottom side of the stick boom cylinder.

When the stick boom rotates to the equipment front immediate proximity position, the stick boom rotates downward to the vertical posture position, thereafter, rotates forward and upward, and the stick boom cylinder hold pressure shifts from the head side to the bottom side through the vertical posture position. Conventionally, the stick boom rotation range of this side from forward is restricted to the position of its vertical posture, because, the stick boom cylinder hold pressure is secured only at the head side.

However, it is preferable that the hydraulic shovel provided with crane function can be operated at the equipment immediate proximity position not only during the excavation or transportation, but also during the crane work and, therefore, it is desirable to provide the corresponding oil chamber side with rotation prevention means of main boom, stick boom and bucket, so as to maintain securely the hold pressure, even when the maximum hold pressure is applied to respective cylinders of main boom, stick boom and bucket and, at the same time, to maintain the hold pressure thereof, even when the hydraulic oil hose is broken.

The stick boom cylinder extends until the stick boom rotates downward and attain the vertical position, and at this time, the stick boom hold pressure is always generated at the stick boom cylinder head side. Therefore, conventionally, a rotation prevention valve has been fitted to the stick boom cylinder head side. However, in crane work or excavation work, when the stick boom rotates from the vertical posture to the rotation upper limit position at the equipment rear side, the stick boom cylinder continues to extend and, at the same time, the hold pressure of the stick boom shifts to the bottom side. Consequently, it is necessary to provide the stick boom cylinder bottom side also with rotation prevention means as the head side as the case of the present invention, in order to rotate the stick boom to the rotation upper limit position at the equipment rear side and hold the same.

In the present invention, similarly as the aforementioned bucket, the stick boom rotation prevention means is directly fixed to at least the bottom side of the stick boom cylinder, and even if the hydraulic oil hose connected to the stick boom cylinder bottom side is broken and the bottom side hydraulic pressure going to be lost when the stick boom is rotating to the equipment rear side maximum rotation position, the stick boom fall prevention means cuts off the cylinder bottom side oil chamber from the exterior oil passage, and maintains the hold pressure of the bottom side oil chamber.

This means that the crane work can be performed not only in the equipment forward side including the stick boom vertical posture by the operation of the stick boom cylinder, but also at the equipment immediate proximity position. As the crane work can be performed in the equipment proximity, and the positional relationship between the hoisting hook and load can be checked with eyes, the work efficiency can be enhanced considerably. In addition, as the crane work range is enlarged, the crane work in a small site can be performed effectively and safely.

On the other hand, during earth and sand excavation and transportation, the stick boom is rotated vertically by the operation of the stick boom cylinder not only in the equipment forward side operation range, but also in the whole rotation range including the equipment rear side, and at the same time, the bucket is made to nod vertically by the operation of the bucket cylinder. The aforementioned composition increases the stick boom rotation range compared to the case where the operation is performed only within the rotation range of the stick boom rotating from the vertical posture to the equipment forward side as in the prior art and, in addition, enlarges the bucket excavation rotation range, and increases the excavation range thereof.

At the same time, it becomes unnecessary to set the limit of the stick boom operation range as in the prior art, and allows to rotate freely within the equipment forward side and equipment backward side rotation limits including the stick boom vertical posture by the operation of the stick boom cylinder. As a result, the safety is secured, the operation range can be extended, allowing to perform an effective earth and sand excavation and transportation work.

If the stick boom fall prevention means is provided at both of the head side and bottom side of the stick boom cylinder, the hold pressure in cylinder extension direction or retraction direction generated by the load of the stick boom, excavated earth and sand or the like is supported instantaneously by the fall prevention means, preventing the stick boom from rotating suddenly downward, and securing the safety in the enlarged aforementioned whole operation range.

In the aforementioned embodiment of the present invention, if the stick boom top pin is rotatably supported by the distal end of the stick boom, and the base end of the hoisting hook is axially supported by the stick boom top pin, it is preferable that the distal end face opposite to the back face of the stick boom comprises a hoisting hook receiving section having an opening and being capable of housing the hoisting hook; a reinforcement member disposed around the peripheral section of the opening; and an engagement member for engaging a hook section of the hoisting hook by hanging.

Such composition, comprising the reinforcement member for closing the opening peripheral section of the hoisting hook receiving section in the stick boom, can secure a sufficient strength of the distal end of the stick boom. As the hoisting hook can be housed in the hoisting hook receiving section of the stick boom, the bucket and the hoisting hook are prevented from interfering, the hoisting hook does not obstructs anything, and is prevented from hitting and damaging obstacles, and at the same time, earth and sands are prevented from entering the hoisting hook receiving section.

In the present invention also, bucket fall prevention means is fitted to the bucket cylinder head side, and the function during the crane work is not substantially different from the aforementioned function. As mentioned above, during the crane work with bucket back face directed downward, for example, even if the hydraulic oil hose connected to the bucket cylinder head side is broken, the bucket fall prevention means acts immediately, cuts off completely the head side oil chamber from the exterior oil passage, maintains the hold pressure of the head side, and prevents the bucket from rotating suddenly downward.

Further, it is preferable that the hoisting hook is linked to a hook rotation driving mechanism for rotating about the stick boom top pin.

Taking effectively profit of the inside space of the aforementioned main boom and stick boom, a simple structure rotation driving mechanism having a pulley around which wire or the like are wound and an electric motor or the like for operating that pulley together are installed for example in the main boom and stick boom, it is made to work together with the stick boom top pin. The hoisting hook is turned in the normal and reverse direction through the rotation driving mechanism by driving the electric motor. For the transition from crane work to excavation work, the hoisting hook can be housed automatically in the aforementioned hoisting hook receiving section by rotating about the stick boom top pin, without requiring manual labor, or the inverse operation can be performed.

DESCRIPTION OF THE PREFERRED EMBODIMENTS

Now, preferred embodiments of the present invention will be described in detail referring to the attached drawings.

Figure 1:
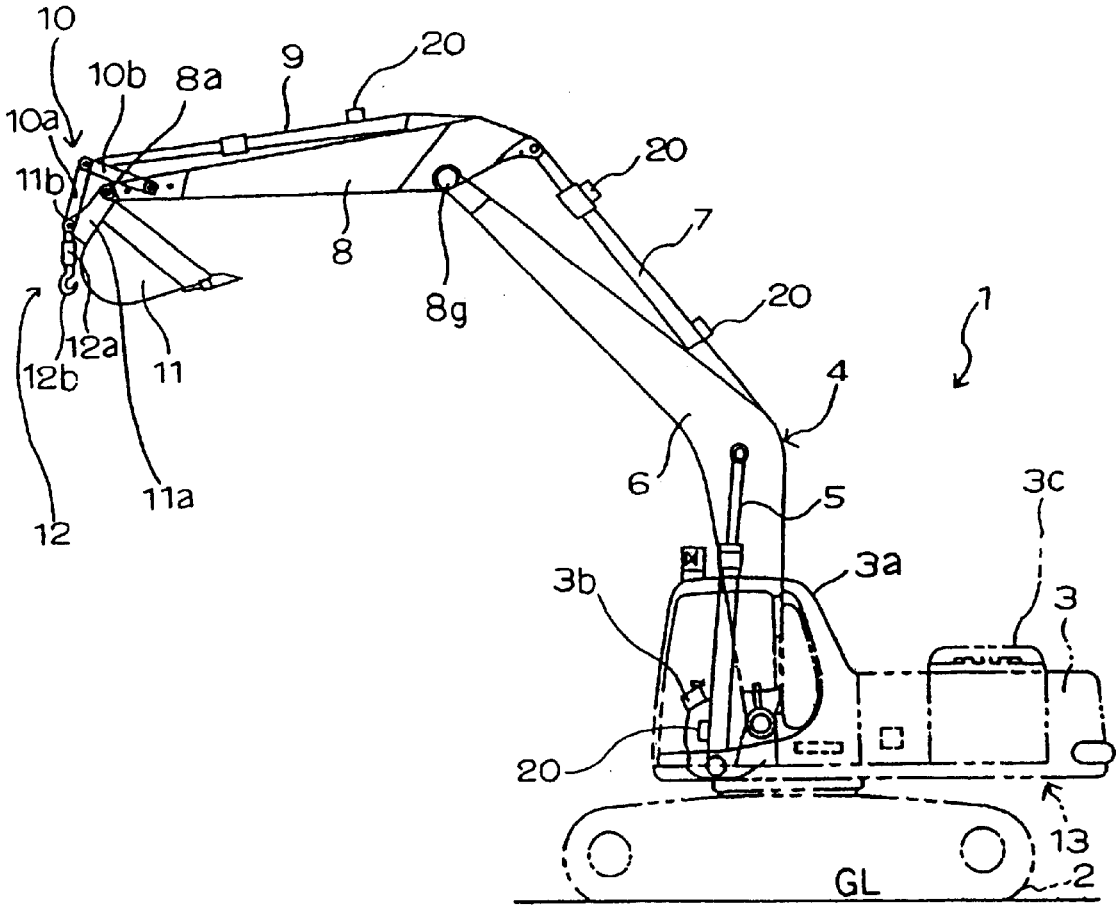
FIG. 1 is a general view showing schematically an example of a hydraulic shovel with a hoisting hook, of a typical embodiment of the present invention.
Figure 2:
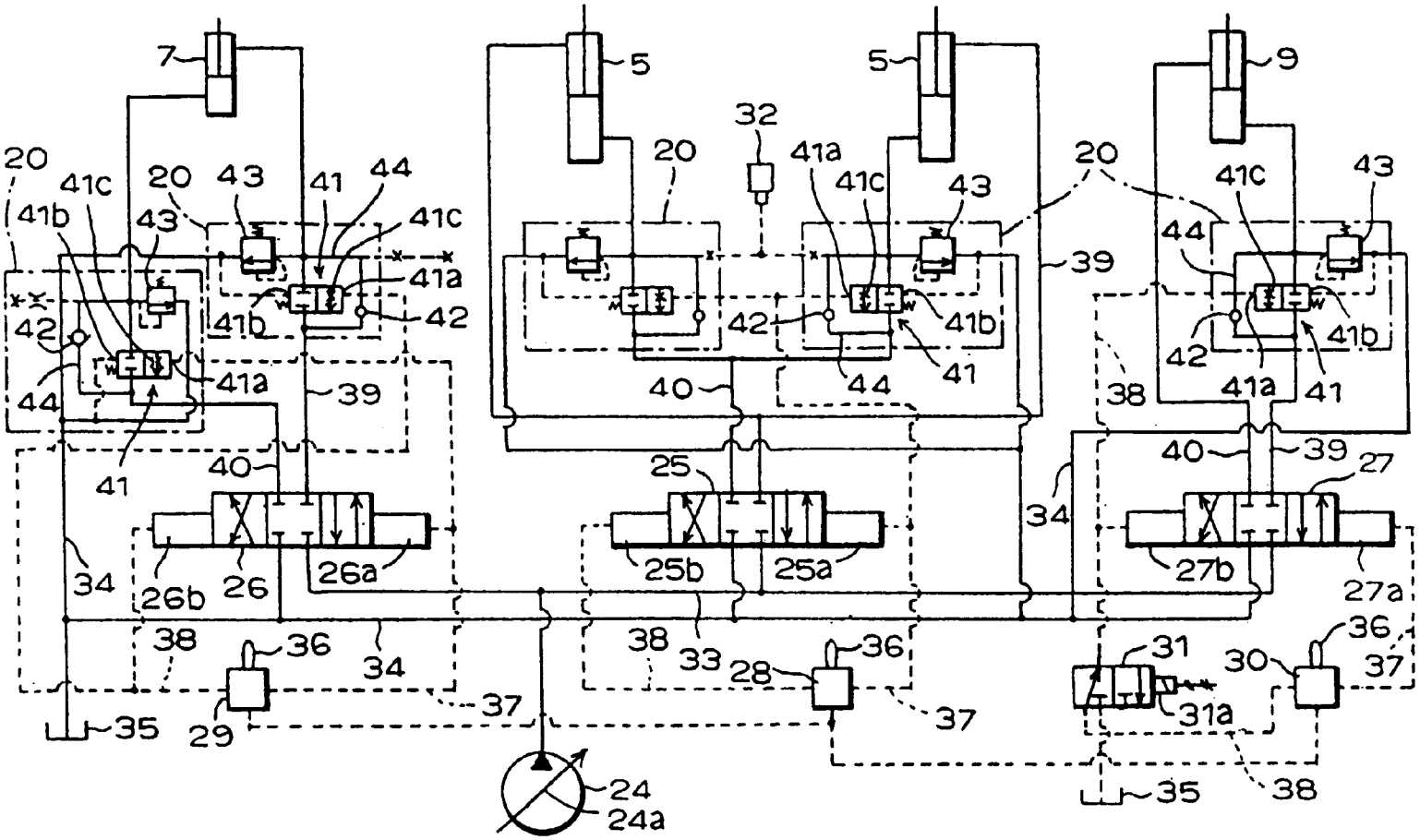
FIG. 2 is a hydraulic circuit diagram of the hydraulic shovel.
Figure 3:
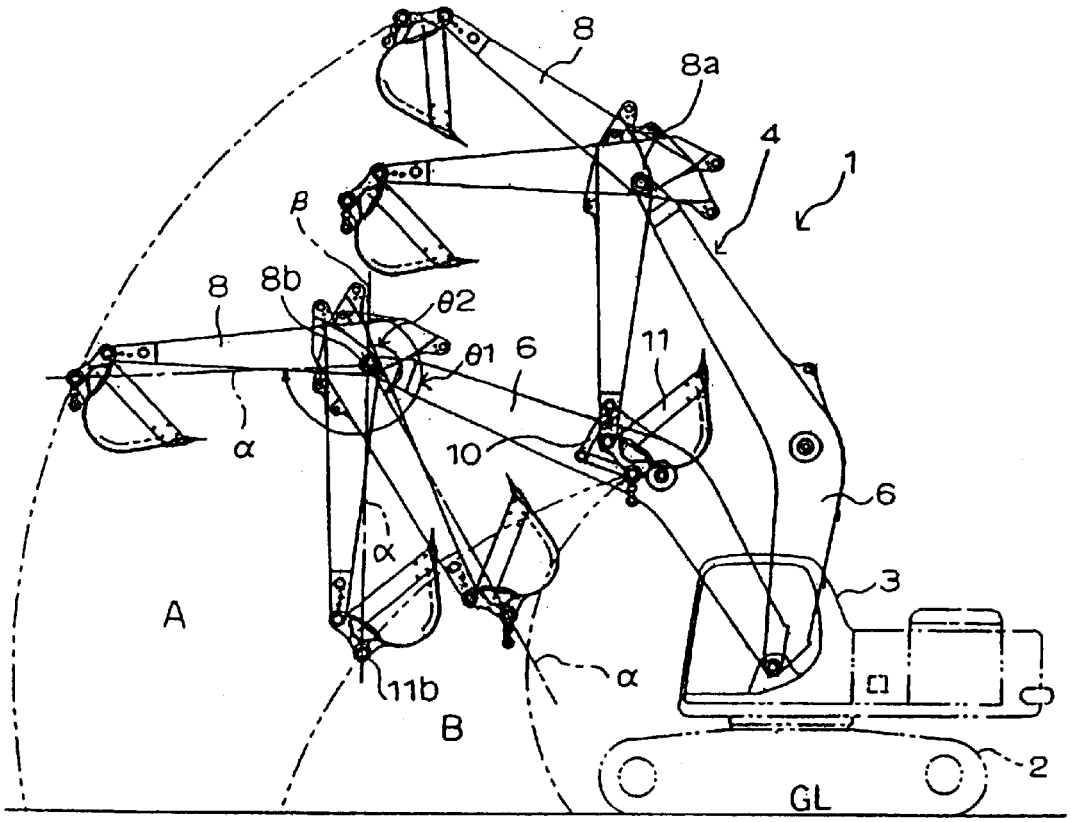
FIG. 3 is a general view showing schematically the operation of an operation machine in the hydraulic shovel.

FIG. 1 is a general view showing schematically an example of a hydraulic shovel provided with a hoisting hook of a representative first embodiment of the present invention, FIG. 2 is a hydraulic circuit diagram of the hydraulic shovel, and FIG. 3 is a general view showing schematically the operation of an operation machine in the hydraulic shovel. In this embodiment, the same member name and numerals are given to the member substantially same as the aforementioned prior art.

In FIG. 1, a hydraulic shovel 1 of the first embodiment comprises a travel body 2, a revolving frame 3 rotatably fitted about the vertical axis on the travel body 2, an equipment 13 disposed on the revolving frame 3 and provided with a cab 3*a*, an engine 3*c* or the like, and an operation machine 4 fitted to the equipment 13. The operation machine 4 comprises a main boom 6 rising substantially from the center of the equipment 13, a stick boom 8 attached to an free end of the main boom and swinging vertically and a bucket 11 supported by a stick boom top pin 8*a* at the distal end of the stick boom 8 and nodding vertically.

The main boom 6 vertically rises and descends about it base end by a pair of main boom cylinders 5, 5 disposed between the main boom 6 and the revolving frame 3. The stick boom 8 swings vertically by a stick boom cylinder 7 attached between the stick boom 8 and the main boom 6 taking the distal end of the main boom 6 as fulcrum. The bucket 11 vertically swings by a bucket cylinder 9 attached through a pair of right and left two-section links 10, 10 between the bucket 11 and the stick boom 8 taking the distal end of the arum 8 as fulcrum.

A pair of landcells 11*a*, 11*a* are disposed at the right and left of a rear wall section of the bucket 11. An end of the landcell 11*a* is swingably supported through the aforementioned stick boom top pin 8*a* of the stick boom 8, and the other end thereof is swingably supported by a rod end of the bucket cylinder 9 through the aforementioned link 10, 10.

A base section 12*a* of a hoisting hook 12 for crane work is rotatably supported by a fixing pin 11*b* coupling a forward side first link 10*a* and the bucket 11. When the hoisting hook 12 is not in use, it is housed between right and left links 10, 10, and a hook section 12*b* of the hoisting hook 12 is hung and engaged by a not shown detachable insertion pin that can be inserted into and retracted from a not shown through hole perforated in the link 10, 10.

As shown in FIG. 2, the hydraulic shovel 1 comprises a variable capacity type pump 24, three command valves 25 to 27 for supply respective cylinders 5, 7, 9 of the operation machine 4 selectively with hydraulic pressure discharged from the variable capacity type pump 24, and three manual command sections 28 to 30 for changing over the command valves 25 to 27 independently.

Moreover, the hydraulic shovel 1 comprises an electromagnetic switchover valve 31 for prohibiting the dumping operation of the bucket 11 (cylinder retraction operation) when the hoisting hook 12 is not housed between the links 10, 10, that is, during crane work, and a pressure sensor 32 for detecting a hydraulic pressure of the main boom cylinder 5 at bottom side for confirming the safe load.

The variable capacity type pump 24 is composed of a swash plate pump and controls the discharge oil amount by varying the swash angle of a swash plate 24*a* by means of a not shown capacity control member. Hydraulic oil discharged from the variable capacity type pump 24 is supplied selectively to the command valves 25 to 27 through an output circuit 33 and return oil from respective cylinders 5, 7, 9 returns to an oil tank 35 through a drain circuit 34.

The command valve 25 to 27 comprises a main boom command valve 25 corresponding to the main boom cylinder 5, a stick boom command valve 26 corresponding to the stick boom cylinder 7 and a bucket command valve 27 corresponding to the bucket cylinder 9. These command valves 25 to 27 are composed of a 4-port 3-position closed center type flow control valve changed over to bottom side, head side or inactive position (neutral position) according to the command position.

The three manual command sections 28 to 30 are composed of a main boom command section 28 corresponding to the main boom command valve 25, a stick boom command section 29 corresponding to the stick boom command valve 26 and a bucket command section 30 corresponding to the bucket command valve 27. Respective command sections 28 to 30 are disposed of the same structure and the same function. Each of these command sections 28 to 30 has a command lever 36 and a not shown first and second pilot proportional control valves for outputting pilot hydraulic pressure according to the command amount (angle) of the command lever 36. Respective command sections 28 to 30 cut off the supply of pilot hydraulic oil to first and second pilot circuits 37, 38 by the activation of a not shown sensor.

The command lever 36 is disposed in the operator cabin 3*a* disposed at a position shifted to the right or to the left from the front center of the revolving frame 3. The pilot oil flow supplied to the pilot proportional control valve from a similarly not shown pilot pump increases according to the command amount of the command lever 36 and a spool of the command valves 25 to 27 opens more according to the pilot pressure of the increased pilot flow, and the more it opens, the more discharge hydraulic oil flow to be supplied to respective cylinders 5, 6, 7 would be.

The pilot hydraulic oil from the first pilot proportional control valve of the main boom command section 28 acts to a first pressure receiving section 25*a* (descending side) of the main boom command valve 25 through the first pilot circuit 37. The pilot hydraulic oil from the second pilot proportional control valve acts to a second pressure receiving section 25*b* (rising side) of the main boom command valve 25 through the second pilot circuit 38.

The pilot hydraulic oil from the first pilot proportional control valve of the stick boom command section 29 acts to a first pressure receiving section 26*a* (dump side) of the stick boom command valve 26 through the first pilot circuit 37. The pilot hydraulic oil from the second pilot proportional control valve acts to a second pressure receiving section 26*b* (excavation side) of the stick boom command valve 26 through the second pilot circuit 38.

The pilot hydraulic oil from the first pilot proportional control valve of the bucket command section 30 acts to a first pressure receiving section 27*a* (excavation side) of the bucket command valve 27 through the first pilot circuit 37. The pilot hydraulic oil from the second pilot proportional control valve acts to a second pressure receiving section 27*b* (dump side) of the bucket command valve 27 from the second pilot circuit 38 through the aforementioned electromagnetic changeover valve 31.

A solenoid 31*a* of the electromagnetic changeover valve 31 prohibiting the dumping operation of the bucket 11 is electrically connected to a not shown controller emitting control signals based on output signals from the aforementioned pressure sensor 32 for detecting the hydraulic pressure of the aforementioned main boom 6 at bottom side, a similarly not shown main boom angle sensor, a similarly not shown stick boom angle sensor, a not shown limit switch for detecting hook insertion and removal disposed between the right and left aforementioned links 10, 10, and a similarly not shown crane mode switches or others arranged in the cab 3*a*.

The controller is electrically connected to a monitor 3*b*, a similarly not shown alarm display device such as buzzer, lamp, or the like in the cab 3*a*. This controller calculate the real load based on respective output signals from the pressure sensor 32, main boom angle sensor, or the like, and compares the calculated value and a predetermined rated load value, to monitor the load state by the load. When the charge load is judged to be excessive, the alarm display device is triggered.

The controller memorizes ON/OFF combination relation of a not shown crane mode switch or limit switch, or the like. The solenoid 31*a* of the aforementioned electromagnetic changeover valve 31 is magnetized or demagnetized based on the command from a control program by inputting these signals.

When the solenoid 31*a* of the aforementioned electromagnetic changeover valve 31 is turned on, the electromagnetic changeover valve 31 is switched over to a position opposite to a position shown in FIG. 2, and closes the second pilot circuit 38 communicating the aforementioned bucket command valve 27 and the bucket command section 30. Pilot hydraulic oil in the second pilot circuit 38 returns to the aforementioned oil tank 35 through the electromagnetic changeover valve 31. The pilot pressure does not act on the dumping side of the bucket command valve 27 even when the bucket command section 30 is operated to the dumping side of the bucket command valve 27. Thus, the aforementioned bucket 11 does not move to the dumping side.

Moreover, for the hydraulic shovel 1, a rotation prevention means 20 which is a characteristic feature of the present invention is directly connected to each of tubular sections of respective cylinders 5, 7, 9. The rotation prevention means 20 is respectively connected to an hydraulic hose having a not shown tube for supplying hydraulic oil from the command valves 25 to 27 for driving respective cylinders 5, 7, 9. The rotation prevention means 20 has a function for preventing the aforementioned operation machine 4 from free fall by maintaining an internal pressure of the cylinder. In this embodiment, as shown in FIG. 1, the rotation prevention means 20 is mounted directly to each of the main boom cylinder 5 bottom side, the stick boom cylinder 7 bottom side and head side, and the bucket cylinder 9 bottom side.

As shown in FIG. 2, the aforementioned rotation prevention means 20 of this embodiment comprises a changeover valve 41 having a throttle 41*c* for cutting off or discharge outside the hydraulic oil of respective cylinders 5, 7, 9, a check valve 42 for connecting before and after the changeover valve 41 for supplying the cylinder 5, 7, 9 with hydraulic oil from the aforementioned variable capacity type pump 24, and a safety valve 43 for securing the set pressure in the cylinder 5, 7, 9. Respective rotation prevention means 20 directly mounted to respective cylinders 5, 7, 9 have a substantially same structure and function. Therefore, for the rotation prevention means 20 (called "rotation prevention valve" hereinafter) described below, the same numeral and member name are allocated to the same member.

A first oil passage 39 and a second oil passage 40 connecting the stick boom cylinder 7 and the stick boom command valve 26 connection port connect to the changeover valve 41. A first pressure receiving section 41*a* of the changeover valve 41 in this first oil passage 39 is connected to the second pilot circuit 38 communicating with the aforementioned stick boom command section 29 (excavation side). A second pressure receiving section 41*b* of the same is connected to the drain circuit 34.

On the other hand, the first pressure receiving section 41*a* of the changeover valve 41 in the second oil passage 40 is connected to the second pilot circuit 37 communicating with the aforementioned stick boom command section 29 (dumping side) while the second pressure receiving section 41*b* of the same is connected to the drain circuit 34. The changeover valve 41 is always maintained at the close position, and is changed over to the open position by the pilot hydraulic oil supplied by operating the stick boom command section 29.

A passage 44 connecting front and rear of the changeover valve 41 connects the check valve 42. Oil discharged from the variable capacity type pump 24 flows into the stick boom cylinder 7 through the check valve 42 by operating the stick boom command section 29. An intersection of the passage 44 of the check valve 42 output side and the first oil passage 39 or an intersection of the passage 44 and the second oil passage 40 is connected to the safety valve 43. The output side of the safety valve 43 is connected to the drain circuit 34. The safety valve 43 is always held in the close position. The safety valve 43 maintains the internal pressure of the cylinders 5, 7, 9 at a predetermined set pressure.

When the stick boom command valve 26 is in the neutral position (inactive state), the safety valve 43, the check valve 42 and the changeover valve 41 close the first and second oil passages 39, 40 connecting to the head side and bottom side of the stick boom cylinder 7, and cut off the oil flow from the head side and bottom side oil chamber to outside.

Now, when the stick boom command section 29 is operated to the dumping side, pilot hydraulic oil acts on the first pressure receiving section 41*a* of the changeover valve 41 at the stick boom cylinder bottom side and the first pressure receiving section 26*a* of the stick boom command valve 26 through the first pilot circuit 37. The stick boom command valve 26 is changed over to the dumping side and the changeover valve 41 is switched over to the open position. Oil discharged from the variable capacity type pump 24 is supplied to the stick boom cylinder 7 head side passing through the check valve 42 from the stick boom command valve 26 through the first oil passage 39 and the passage 44. On the other hand, the flow of hydraulic oil in the stick boom cylinder 7 bottom side is adjusted by the throttle 41*c* of the bottom side changeover valve 41 and returns to the oil tank 35 from a connection port of the stick boom command valve 26 through the drain circuit 34. As the flow of this return oil is adjusted by the throttle 41*c*, it can operate the stick boom cylinder 7 at a very low speed.

On the contrary, when the stick boom command section 29 is operated to the excavation side, pilot hydraulic oil acts on the first pressure receiving section 41*a* of the changeover valve 41 and the second pressure receiving section 26*b* of the stick boom command valve 26 connected to the stick boom cylinder 7 head side through the second pilot circuit 38, and the stick boom command valve 26 is changed over to the excavation side and the changeover valve 41 at head side is switched over to the open position. Oil discharged from the variable capacity type pump 24 is supplied to the bottom side of the stick boom cylinder 7 passing through the second oil passage 40 and the passage 44. On the other hand, the flow of hydraulic oil in the stick boom cylinder 7 head side returns to the oil tank 35 from the head side changeover valve 41 passing the connection port of the stick boom command valve 26 through the drain circuit 34.

On the other hand, the second oil passage 40 connecting respective bottom side of the aforementioned pair of right and left main boom cylinders 5, 5 and the single main boom command valve 25 connects respectively the main boom rotation prevention valve 20. In addition, the first oil passage 39 connecting the bottom side of the bucket cylinder 9 connects the bucket rotation prevention valve 20.

The first oil circuit 39 communicating with the aforementioned main boom command valve 25 branches at its middle portion and connects to the aforementioned main boom cylinder 5 head side. The second oil passage 40 branches at its middle portion and connects to the aforementioned main boom cylinder 5 bottom side through the main boom rotation prevention valve 20.

If the command lever 36 of the aforementioned main boom command section 28 is operated to the rising side, pilot hydraulic oil from the main boom command section 28 acts on the second pressure receiving section 25*b* of the main boom command valve 25 through the second pilot circuit 38, and changes the main boom command valve 25 to the rising side. Oil discharge from the aforementioned variable capacity type pump 24 is divided at the middle section of the second oil passage 40 and supplied to each main boom cylinder 5 bottom side through the check valve 42 of the main boom rotation prevention valve 20. On the other hand, the head side hydraulic oil joins at the middle section of the first oil passage 39, and returns to the oil tank 35 passing the drain circuit 34 through the main boom command valve 25.

If the command lever 36 of the aforementioned main boom command section 28 is operated to the descending side, pilot hydraulic oil from the main boom command section 28 acts on the first pressure receiving section 25*a* of the main boom command valve 25 through the first pilot circuit 37, acts on the first pressure receiving section 41*a* of each changeover valve 41 through the first pilot circuit 37 divided at the middle section, and changes the main boom command valve 25 to the descending side and respective changeover valve 41 to the open position. Oil discharge from the aforementioned variable capacity type pump 24 is divided at the middle section of the first oil passage 39 and supplied to respective main boom cylinder 5 head side. On the other hand, the bottom side hydraulic oil joins at the middle section of the second oil passage 40 through the changeover valve 41, and returns to the oil tank 35 passing the main boom command valve 25 connection port through the drain circuit 34.

The first pressure receiving section 41*a* of the changeover valve 41 connected to the first oil passage 39 communicating with the connection port of the bucket command valve 27 is connected to the second pilot circuit 38 communicating with the aforementioned bucket command section 30 (dumping side) through the electromagnetic changeover valve 31, while the second receiving section 41*b* is connected to the drain circuit 34.

When the electromagnetic changeover valve 31 is in inactive state shown in FIG. 2, the command lever 36 of the aforementioned bucket command section 30 is operated to dumping side, pilot hydraulic oil acts on the first pressure receiving section 41*a* of the changeover valve 41 and the bucket command valve 27 dumping side through the second pilot circuit 38. As mentioned above, if the electromagnetic changeover valve 31 is changed over in response to an erroneous operation of the crane mode switch during the crane work, the second pilot circuit 38 is to be closed. As the result, the pilot pressure does not act on the bucket command valve 27, disabling the dumping side operation by the bucket command section 30. When the command lever 36 of the bucket command section 30 and the command lever 36 of the stick boom command section 26 are operated mutually in the opposite direction, the bucket cylinder 9 and the stick boom cylinder 7 extend and retract substantially in the same direction.

In the hydraulic shovel 1 of this embodiment, the base section of the main boom 6 is fitted to the equipment 13 in the erected posture where the aforementioned main boom cylinder 5 is extended and the main boom 6 is raised and descended vertically by elongating and retracting the main boom cylinder 5. As the result, a force in the retraction direction always acts on the main boom cylinder 5 by the own weight of the aforementioned operation machine 4 or the like and generates a hold pressure at the bottom side. However, in case of the aforementioned stick boom 8 or bucket 11, a hold pressure is generated for holding a force acting in the extension direction or retraction direction of the aforementioned stick boom cylinder 7 or bucket cylinder 9 depending on the operation posture of the operation machine 4.

As shown in FIG. 3, a cylinder extension direction force always acts on the stick boom 8 and generates a hold pressure at the head side when an inclination angle $\theta$ made by a straight line $\alpha$ connecting support axis 8*g* of the stick boom 8 and a link attachment fixing pin 11*b* of the bucket 11 and a line $\beta$ perpendicular to the ground surface and directed upward starting from the support axis 8*g* is within the range at the equipment forward side from the vertical posture of the stick boom 8 ($\theta 1>180$ degrees), in short, in the rotation range from the vertical position of the stick boom 8 to the forward side rotation upper limit position of the equipment.

In addition, the stick boom cylinder 7 continues to extend, and the stick boom 8 hold pressure shits to the bottom side, when the inclination angle $\theta$ is within the range at the equipment backward side from the vertical posture of the stick boom ($\theta 2<180$ degrees), in short, when the stick boom 8 is rotated in a way to retract from the vertical position to the backward side rotation upper limit position at the equipment. Therefore, an cylinder retraction direction force is always applied to the stick boom 8, and a hold pressure is generated at the bottom side.

On the other hand, when the bucket cylinder 9 is extended, and the maximum excavation posture with the bucket 11 retracted and stopped at the stick boom under face side is maintained, in almost all the rotation range of the stick boom 8 irrespective of the inclination angle $\theta$ of the stick boom 8, a cylinder retraction direction force is always applied to the bucket 11 and a hold pressure is generated at the bucket cylinder 9 bottom side. On the contrary, when the bucket cylinder 9 is retracted and the bucket 11 is shifted from the maximum excavation posture to the maximum dumping posture, in almost all the rotation range of the stick boom 8 irrespective of the inclination angle $\theta$ of the stick boom 8, a cylinder extension direction force is always applied to the bucket cylinder 9 and a hold pressure is generated at the bucket cylinder 9 head side.

The present invention consists in directly mounting the rotation prevention valve 20 at any different desired cylinder hold pressure generation area depending on the structure or operation mode of the aforementioned operation machine, and has a most important composition in directly mounting the rotation prevention valve 20 at least on the bottom side of the stick boom cylinder 7 and at least on the bottom side of the bucket cylinder 9.

These features allow to rotate the stick boom 8 securing the safety within the whole rotation range in the equipment forward side and the equipment backward side including the stick boom vertical posture by the operation of the stick boom cylinder 7, and nod the bucket 11 vertically securing the safety when the bucket cylinder 9 is operated.

During the earth and sand excavation or transportation work, and while the stick boom 8 is rotated to the maximum rotation position at the equipment backward side, even if the hydraulic oil hose connected to the bottom side of the stick boom cylinder 7 is broken and the bottom side hydraulic pressure is lost, the stick boom rotation prevention valve 20 acts instantaneously, cuts off completely the cylinder bottom side oil chamber from the exterior oil passage, and maintains the hold pressure of the bottom side oil chamber. Therefore, the stick boom 8 is prevented from rotating downward suddenly, and the stick boom cylinder 7 head side is provided with a rotation prevention valve 20 as in the prior art.

Consequently, this embodiment allows to extend the stick boom operation range to the forward and backward maximum swing limit position including the vertical posture. In other words, as the hold pressure in the cylinder extension direction and retraction direction by the load of the stick boom 8 and excavated earth and sand is supported instantaneously by the rotation prevention valve 20, the stick boom 8 is prevented from rotating downward suddenly, the safety is secured in the extended whole operation range.

Therefore, it becomes unnecessary to set the limit operation range of the stick boom 8 as in the prior art, and the stick boom 8 can rotate freely within the whole rotation range in the equipment forward side and the equipment backward side including the stick boom vertical posture (symbols A, B shown in FIG. 3) by the operation of the stick boom cylinder 7. Such extension of operation range leads to an effective earth and sand excavation and transport operation.

When excavated earth and sand are transported to the dumping position, the bucket cylinder 9 is extended, and the bucket 11 is maintained at the maximum excavation posture. Similarly as the aforementioned stick boom 8, since the bucket rotation prevention valve 20 is directly mounted on the bottom side oil chamber of the cylinder 9, the cylinder extension direction force applied by the own weight of the bucket 11 and excavated earth and sand or the like is supported, and even if the hydraulic oil hose connected to the bottom side oil chamber is broken, the stick boom rotation prevention valve 20 maintains the hold pressure of the bottom side oil chamber; therefore, the bucket 11 is prevented from rotating downward suddenly. Thus, the rotation range of the stick boom 8 increases, and at the excavation rotation range of the bucket 11 can also be enlarged, as well as its excavation range.

During the crane work, a not shown insertion/removal pin attached to the links 10, 10 is removed and the hoisting hook 12 housed between the links 10, 10 is rotated and exposed to outside from links 10, 10. At this time, in order to prevent the bucket 11 and the hoisting hook 12 from interfering, the bucket cylinder 9 needs to be extended to its extension limit to hold the bucket 11 at its most retracted position at under side of the stick boom 8. When the bucket cylinder 9 is extended to its extension limit, the maximum hold pressure is always generated at the bottom side of the bucket cylinder 9 by the own weight of the bucket 11. The crane work by the hoisting hook 12 is performed maintaining a posture where this bucket 11 scoop face side being directed upward.

When a load is to be lifted, even if the hydraulic oil hose connected to the bucket cylinder 9 bottom side is broken, the bucket rotation prevention valve 20 acts instantaneously, cuts off completely the cylinder bottom side oil chamber from the exterior oil passage, and maintains the hold pressure of the bottom side oil chamber; therefore, the bucket 11 is prevented from rotating downward suddenly and the lifted load is also prevented from free fall. The extension of the operation range of the aforementioned stick boom 8 allows to operate the crane in the vicinity of the equipment 13 and to confirm the positional relation of the hoisting hook 12 and the load by watching with eyes, increasing the operation efficiency considerably. In addition, as the operation range of the crane work range is enlarged, the crane work in a small site can be performed effectively and safely.

Figure 4:
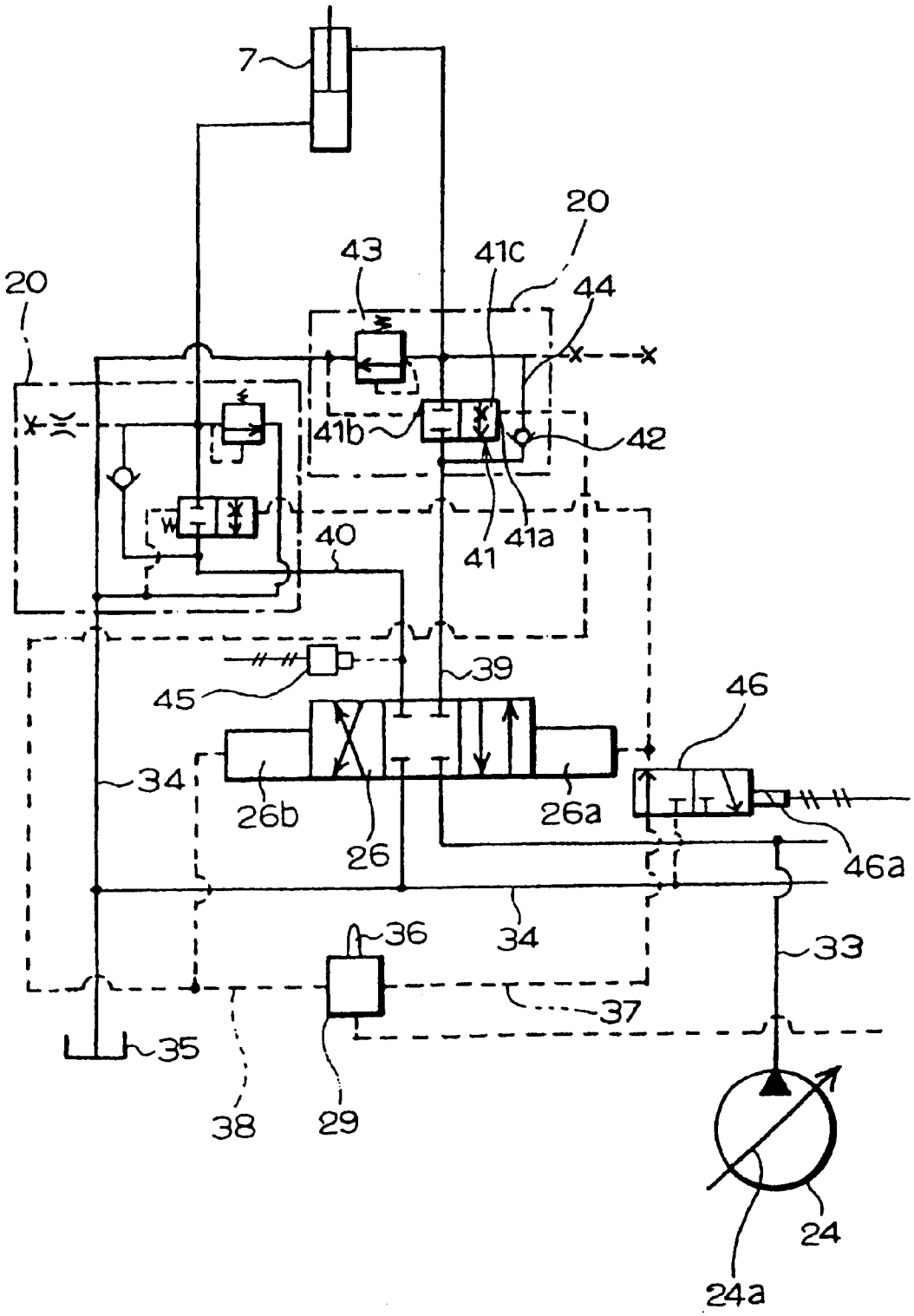
FIG. 4 is another hydraulic circuit diagram applied to the operation machine.

FIG. 4 shows another hydraulic circuit for driving the stick boom cylinder 7. In this second embodiment, as an example, the bottom side of the aforementioned stick boom cylinder 7 will be explained, but the present invention is not limited to this, and it can similarly be applied to the head side of the stick boom cylinder 7, the other main boom cylinder 5 or bucket cylinder 9. In FIG. 4, members substantially similar to the hydraulic circuit for the stick boom cylinder 7 shown in FIG. 2 are indicated by the same member name and numeral; so the detailed description of these members are omitted.

As shown in the FIG. 4, a pressure sensor 45 is provided to detect the hydraulic pressure of the second oil passage 40 connecting the connection port of the stick boom command valve 26 and the bottom side of the stick boom cylinder 7. The first pilot circuit 37 for communicating the stick boom command valve 26 (dumping side) and the stick boom command section 29 connects an electromagnetic changeover valve 46 for automatic return of the stick boom command valve 26 in operation to the inactive position.

When the stick boom cylinder 7 is retracted by operating the command lever 36 to the dumping side, the head side of the stick boom cylinder 7 is supplied with oil discharged from the aforementioned variable capacity type pump 24 through the output circuit 33, the stick boom command valve 26, the first oil passage 39, and the check valve 42. On the other hand, hydraulic oil of the cylinder bottom side returns to the oil tank 35 through the changeover valve 41 changed to the open position by the pilot pressure, the second oil passage 40, the stick boom command valve 26 and the drain circuit 34. At this moment, even if the hydraulic oil hose connected to the bottom side oil chamber is broken and the hydraulic pressure in the second oil passage 40 varies, the leak pressure is detected by the pressure sensor 45, and the hydraulic pressure detection signal thereof is output to a not shown controller.

This controller is connected to the aforementioned alarm display device in order to monitor the abnormality of hydraulic pressure. The controller compares the detected hydraulic pressure value outputted from the pressure sensor 45 and a predetermined normal hydraulic pressure, and judges whether or not the hydraulic pressure in the second oil passage 40 shows normal hydraulic pressure value. If the hydraulic pressure in the second oil passage 40 exceeds the predetermined value, the controller emits a changeover signal to the electromagnetic changeover valve 46. When a solenoid 46*a* of the electromagnetic changeover valve 46 is turned on by the changeover signal from the controller, the electromagnetic changeover valve 46 is changed over to the position opposed to the position shown in FIG. 4, and closes the first pilot circuit 37. The pilot oil in the first pilot circuit 37 returns to the oil tank 35 through the drain circuit 36.

Thus, the stick boom command valve 26 returns automatically to the inactive position shown in FIG. 4, and stops the oil flow from the hydraulic hose. At the same time, the changeover valve 41 of the aforementioned stick boom rotation prevention valve 20 at the cylinder bottom side returns to the close position shown in FIG. 4, closes the second oil passage 440 connecting the bottom side of the stick boom cylinder 7 and cuts off the hydraulic oil flow from the bottom side to outside completely. Also, the cylinder head side hydraulic oil flow to outside is cut off completely by the aforementioned stick boom rotation prevention valve 20 of the head side. Therefore, even when the stick boom operation section 29 is in operation, the stick boom rotation prevention valve 20 can be operated securely and rapidly to the close position, allowing to perform the hydraulic shovel 1 operation effectively and safely.

Figure 5:
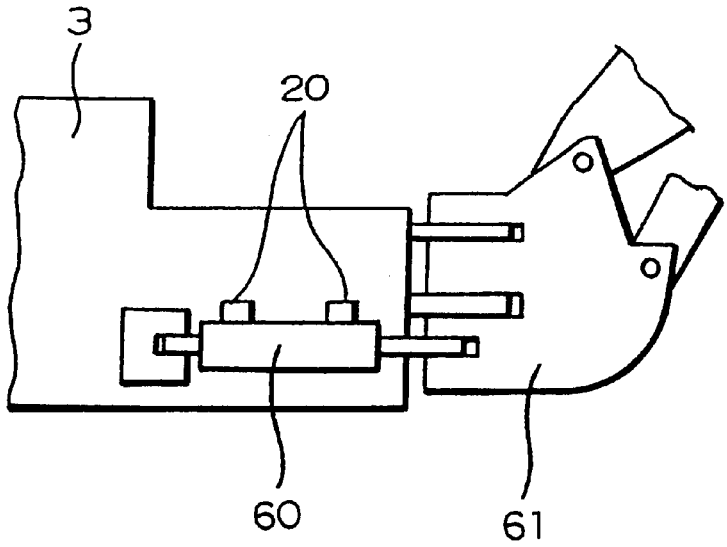
FIG. 5 is a fragmentary enlarged view showing schematically essential parts of a hydraulic shovel comprising a swing type main boom.
Figure 6:
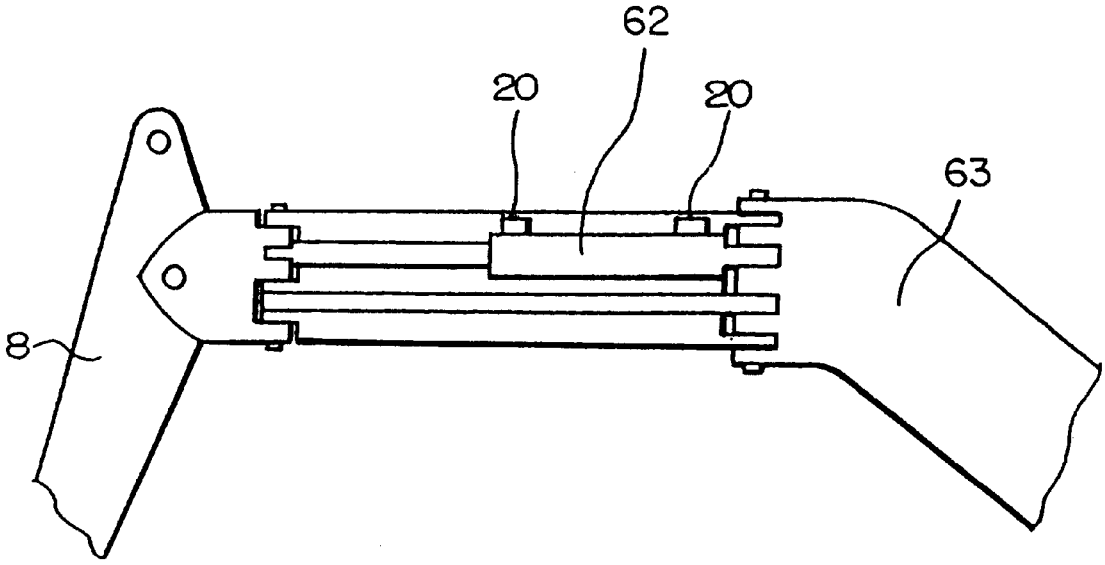
FIG. 6 is a partial enlarged view showing schematically essential parts of a hydraulic shovel comprising an offset type main boom.

FIG. 5 and FIG. 6 show essential parts of a hydraulic shovel comprising a swing type or offset type main boom.

As shown in FIG. 5, a swing boom 61 is rotatably supported by the revolving frame 3. The swing boom 61 swings right and left by the operation of a swing boom cylinder 60 attached to the rear portion of the revolving frame 3. A boom rotation prevention valve 20 having the same structure as the aforementioned first embodiment is directly fixed to the head side and bottom side of the cylinder 60.

As shown in FIG. 6, an offset boom 63 attached to the aforementioned revolving frame 3 at its base section, is rotatably supported at the middle section thereof. An offset boom cylinder 62 is attached to the middle section of the offset boom 63 as fulcrum. The stick boom 8 swings right and left by the operation of the offset boom cylinder 62 taking the distal end section of the offset boom 63. The boom rotation prevention valve 20 same as the aforementioned first embodiment is directly fixed to the head side and bottom side of the offset boom cylinder 60.

As the boom rotation prevention valve 20 is directly fixed to any of cylinders 60, 62 at the head side and bottom side thereof, when the swing boom 61 and the distal end section of the offset boom 63 are rotated, even if the hydraulic oil hose connected to the head side or bottom side is broken, the boom rotation prevention means 20 fixes the booms 61, 63 at their rotation position, prohibiting an unnecessary oscillation.

Figure 7:
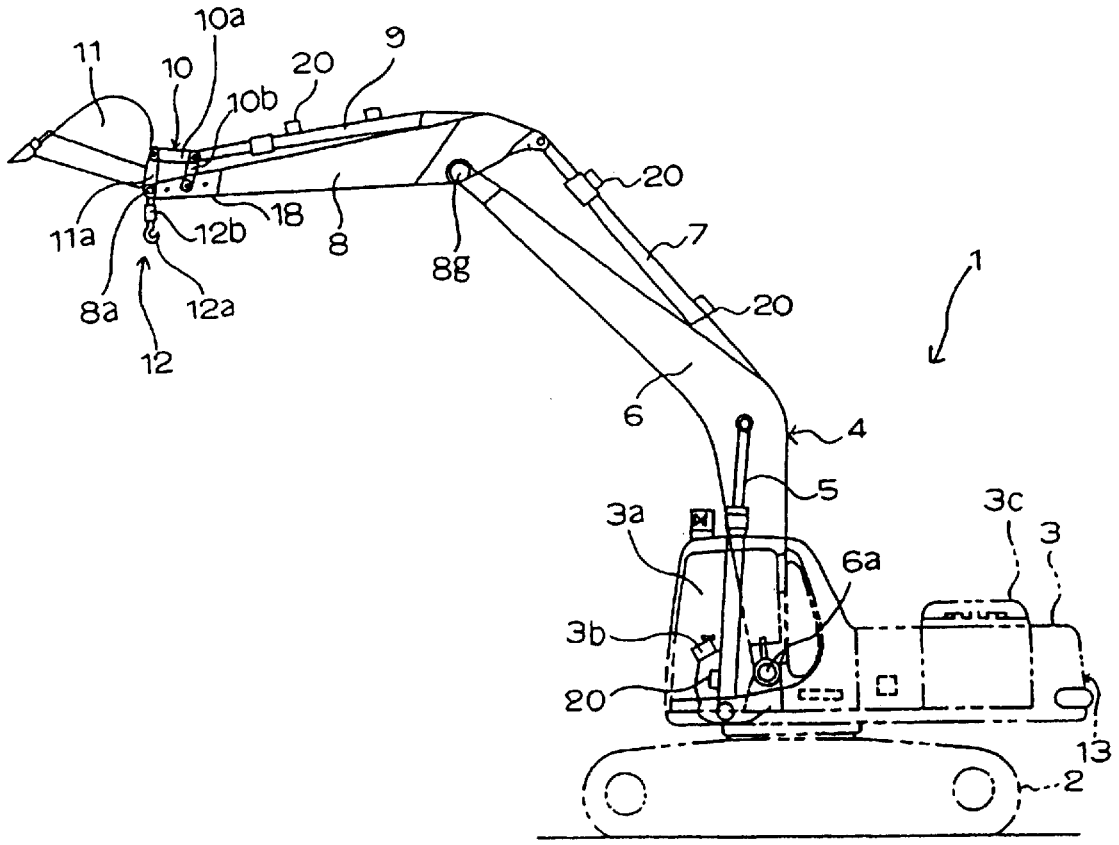
FIG. 7 is a general view shown schematically an example of a hydraulic shovel with the hoisting hook, of another typical embodiment of the invention.
Figure 8:
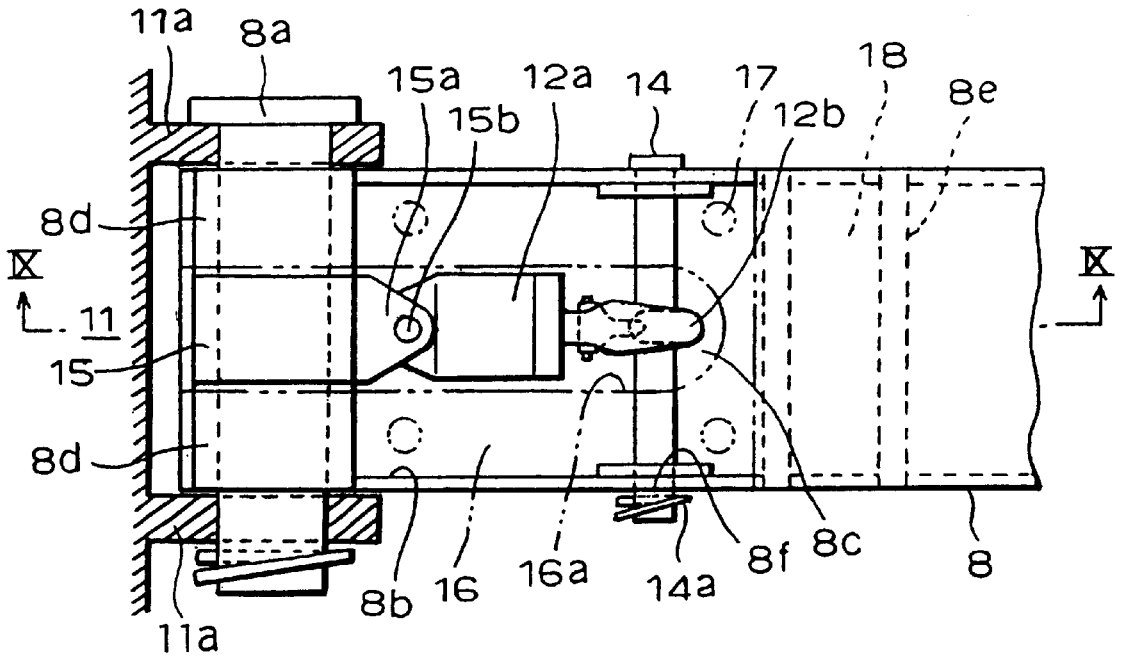
FIG. 8 is a fragmentary enlarged view showing a hoisting hook receiving section of the hydraulic shovel.
Figure 9:
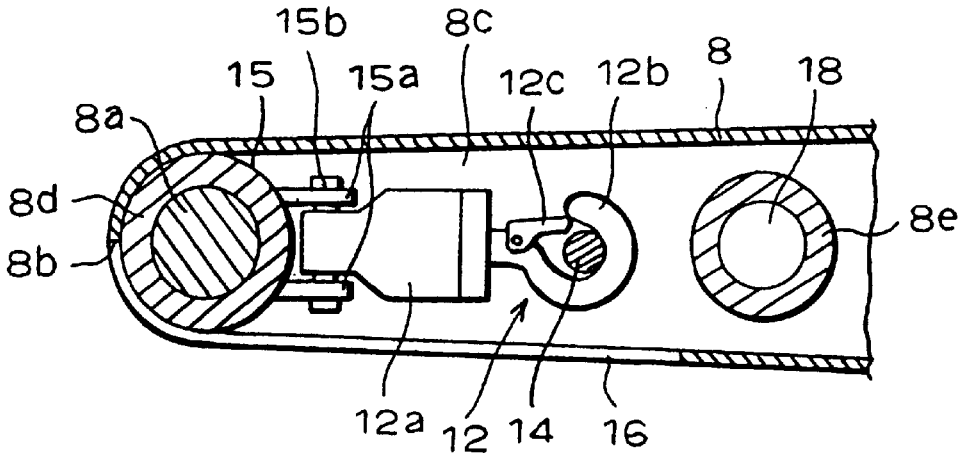
FIG. 9 is an enlarged view along the line IX—IX of FIG. 8.
Figure 10:
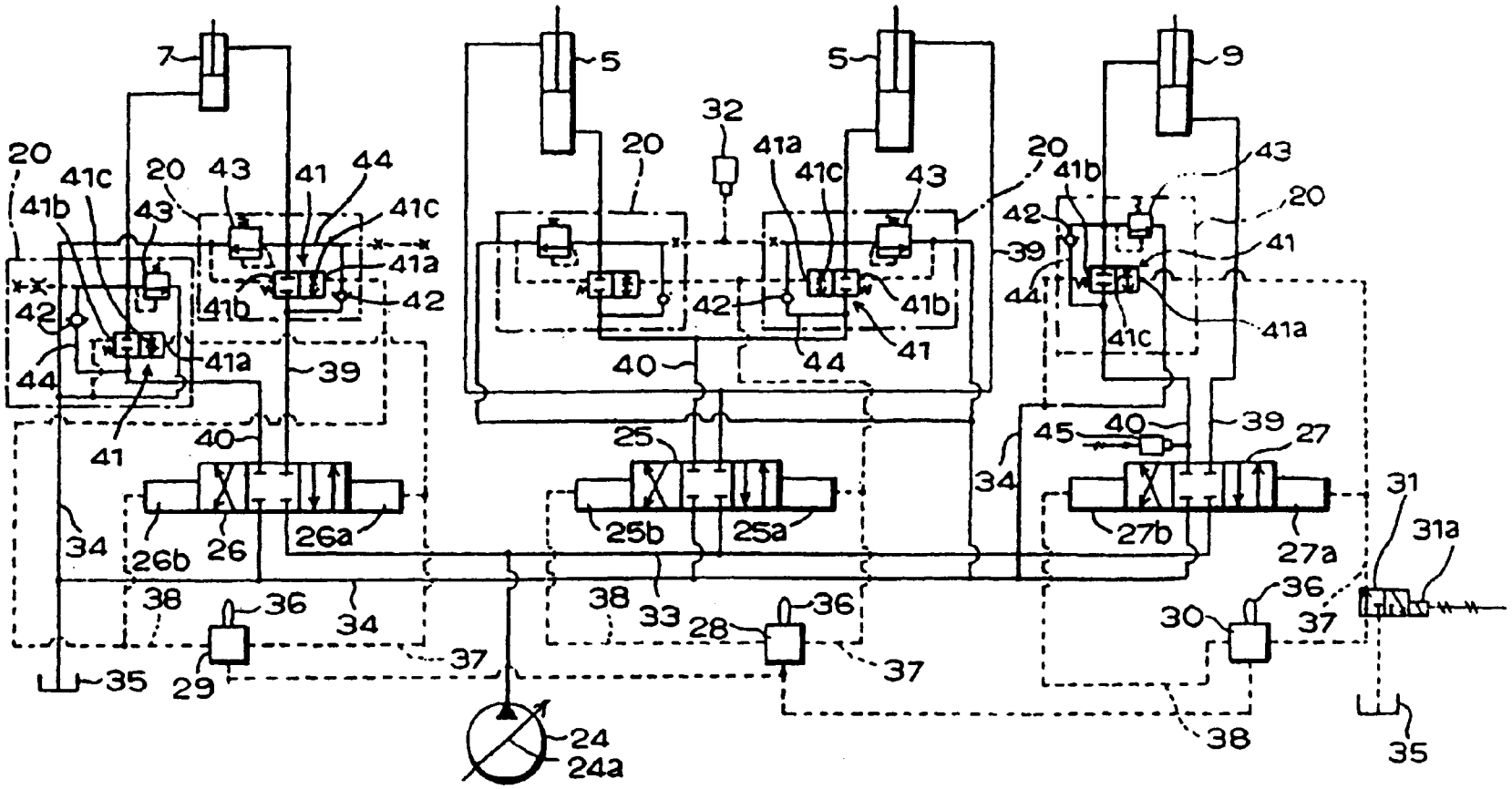
FIG. 10 is a hydraulic circuit diagram of the hydraulic shovel.
Figure 11:
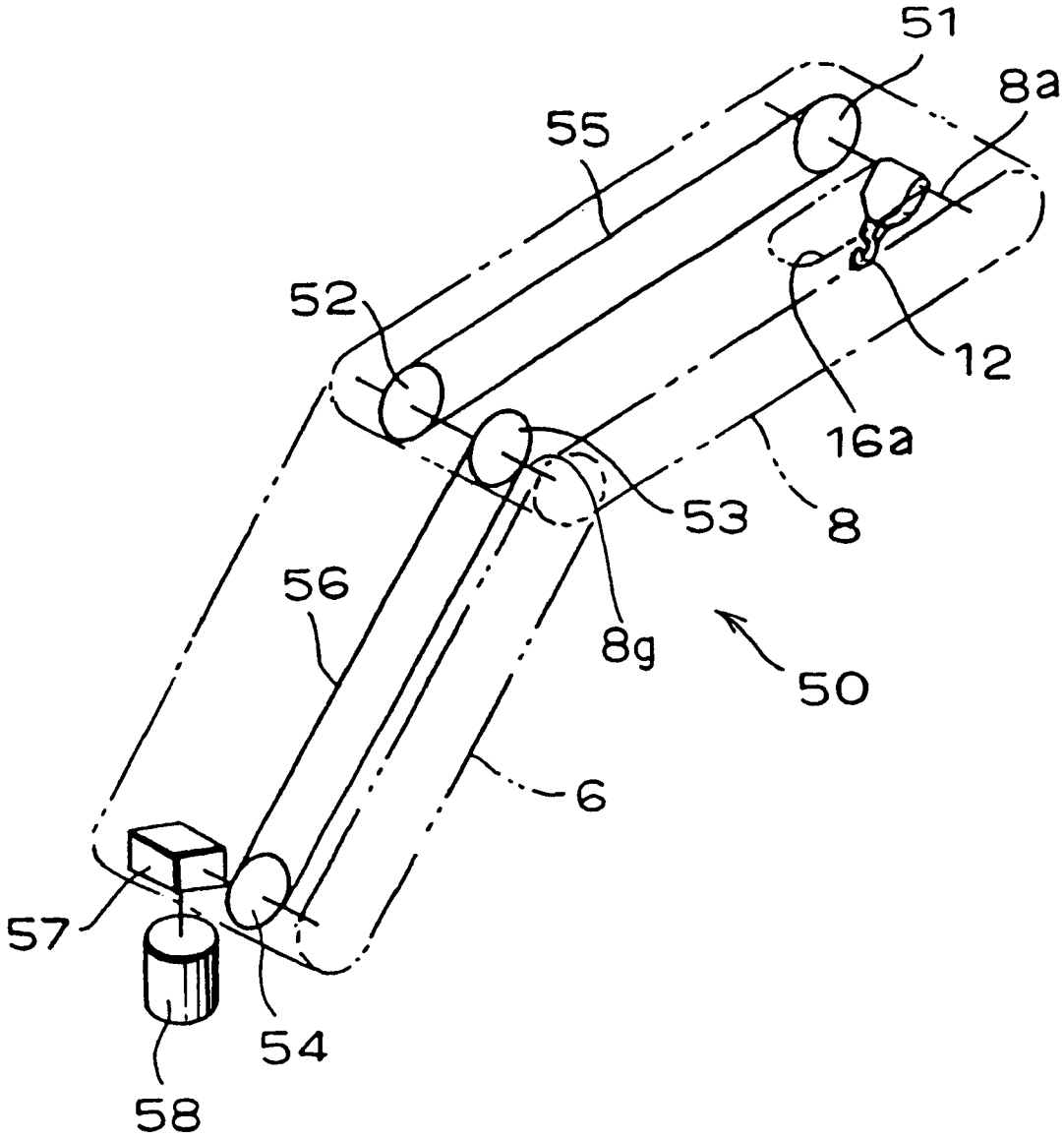
FIG. 11 is a schematic diagram showing an example of a hoisting hook rotation driving mechanism applied to a hoisting hook.
Figure 12:
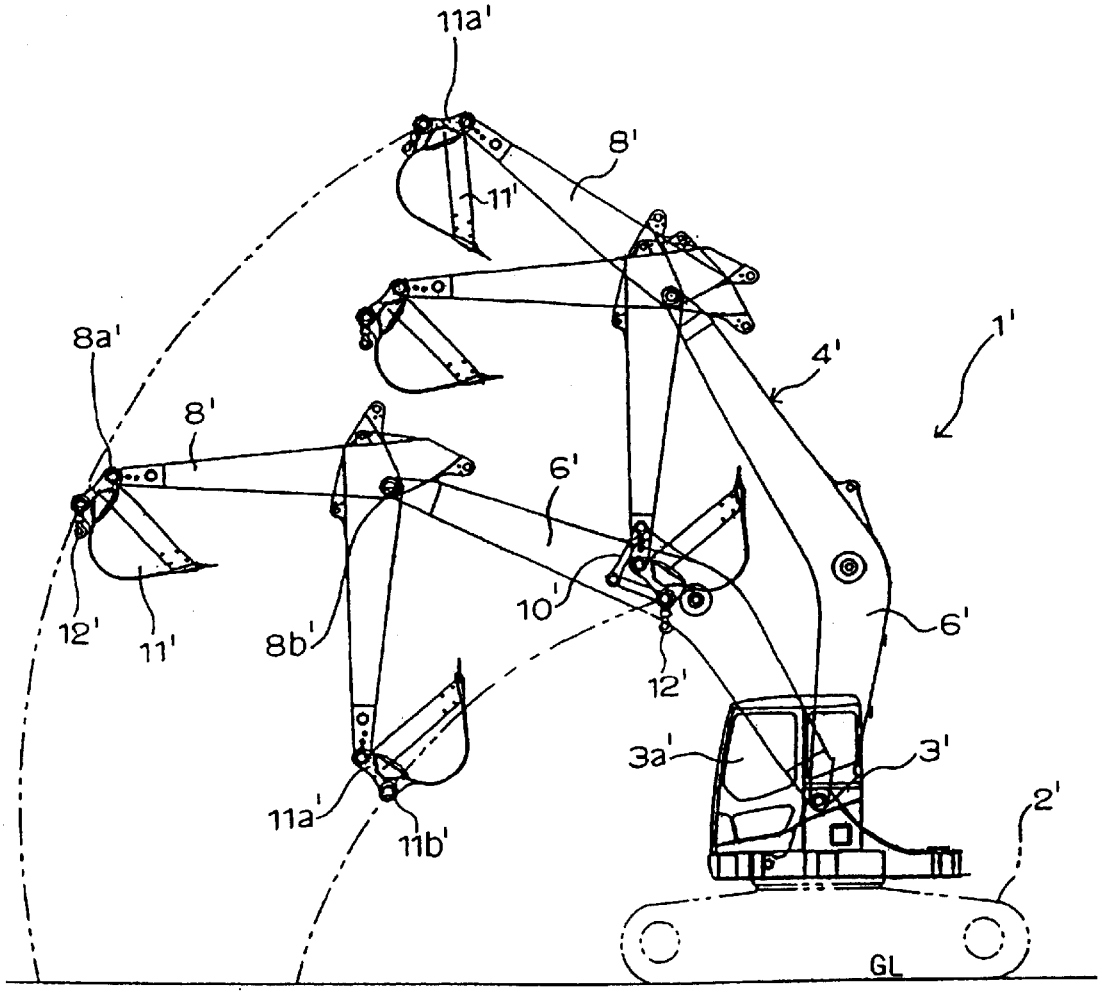
FIG. 12 PRIOR ART
FIG. 12 is a general view showing schematically an example of a conventional hydraulic shovel provided with a hoisting hook.

FIG. 7 to FIG. 10 show a typical second embodiment of the present invention. FIG. 7 is a general view showing schematically an example of a hydraulic shovel provided with a hoisting hook, FIG. 8 is a fragmentary enlarged view showing a hoisting hook receiving section of the hydraulic shovel, FIG. 9 is an enlarged view along the line IX—IX of FIG. 8, FIG. 10 is a hydraulic circuit diagram of the hydraulic shovel, and FIG. 11 is a schematic diagram showing an example of a hoisting hook rotation driving mechanism of the hydraulic shovel. In this embodiment, members substantially similar to the aforementioned first embodiment are indicated by the same member name and numeral; so the detailed description of those members are omitted.

In FIG. 8, a pair of landcells 11*a*, 11*a* are disposed at the right and left of a rear wall section of the bucket 11. An end of the bucket landcell 11*a* is swingably supported through the stick boom top pin 8*a* of the stick boom 8, and the other end of the bucket landcell 11*a* is swingably supported by a rod end of the bucket cylinder 9 through the links 10, 10.

As shown in FIG. 8 and FIG. 9, the lower face side distal end section of the stick boom 8 is provided with an opening 8*b* formed at is longitudinal backward, and comprises a hoisting hook receiving section 8*c* capable of housing the hoisting hook 12. A pair of right and left cylindrical first boss sections 8*d*, 8*d* in which the stick boom top pin 8*a* can be inserted protrude in opposition in the hoisting hook receiving section 8*c*. A cylindrical single second boss section 8*e* in which a support pin 18 supporting rotatably ends of the right and left links 10, 10 can be inserted is fixed to the inside of the stick boom 8 behind the first boss section 8*d*. An insertion hole 8*f* is perforated in each of right and left side wall sections of the stick boom 8 between respective first and second boss sections 8*d*, 8*e*, and a cylindrical engagement member 14 is detachably fixed by a lock pin 14*a*.

The hoisting hook 12 is fixed vertically rotatably in the first boss section 8*d* through a cylindrical bracket 15 supported by the stick boom top pin 8*a* of the stick boom 8. A pair of stick boom sections 15*a*, 15*a* protrude in parallel from the bracket 15 along its rotation axial direction from the bracket 15. The hoisting hook 12 has a base section 12*a* axially supported to be swingable right and left through an attaching pin 15*b* provided in respective stick boom sections 15*a*, 15*a* and a hook section 12*b* protruding from the base section 12*a*. A retention piece 12*c* provided on the opening of the hook section 12*b* is arranged in the cab direction.

A reinforcement member 16 whose one end forms a regularly curving plate is fixed at the periphery of the opening of the hoisting hook receiving section 8*c* by four bolts 17, . . . , 17. This reinforcement member 16 has a shape in compliance with the shape of the lower face side distal end section of the stick boom 8. An insertion/removal opening 16*a* of substantially U form for inserting or removing the hoisting hook 12 is formed at the substantially middle section of the reinforcement member 16. Being provided with the reinforcement member 16 closing the periphery of the opening of the hoisting hook receiving section 8*c*, a sufficient strength of the opening of the distal end of the stick boom 8 can be secured.

During the crane work, the retention piece 12*c* of the aforementioned hoisting hook 12 is extracted from the engagement member 14 attached to the hoisting hook receiving section 8*c* of the stick boom 8, and the hoisting hook 12 housed in the hoisting hook receiving section 8*c* is rotated, and exposed outside from the hoisting hook receiving section 8*c*. When the hoisting hook 12 is not in use, it is housed in the hoisting hook receiving section 8*c*, and the hoisting hook 12 is engaged and fixed by the engagement member 14 through the retention piece 12*c*.

With this structure, the hoisting hook 12 can be housed in the hoisting hook receiving section 8*c*, so that the bucket 11 and the hoisting hook 12 are prevented from interfering, the hoisting hook 12 does not obstruct, and is prevented from hitting and damaging obstacles, and at the same time, earth and sands are prevented from entering the hoisting hook receiving section 8*c*. The hoisting hook 12 is disposed to hung at the bucket scooping face side from the stick boom top pin 8*a*, allowing the operator to watch the hoisting hook 12, the forward sight being not interrupted by the bucket 11, and to perform the crane work effectively and safely.

As shown in FIG. 10, similarly as the aforementioned first embodiment, the hydraulic shovel 1 comprises a variable capacity type pump 24, three command valves 25 to 27 for supplying respective cylinders 5, 7, 9 of the operation machine 4 selectively with hydraulic pressure discharged from the variable capacity type pump 24, and three manual command sections 28 to 30 for changing over the command valves 25 to 27 independently.

In the hydraulic circuit shown in FIG. 10, its basic circuit is the same as the hydraulic circuit shown in FIG. 2, and therefore, its basic function is similar to the hydraulic circuit mentioned above, so the description of basic circuit and basic function will be omitted.

In this embodiment, instead of disposing the electromagnetic changeover valve 31 of the hydraulic circuit of the first embodiment shown in FIG. 2 in the second pilot circuit 38 communicating the dumping side of the bucket command valve 27 and the bucket command section 30, it is disposed in the first pilot circuit 37 communicating the excavation side of the bucket command valve 27 and the bucket command section 30, so that excavation motion of the bucket 11 (bucket cylinder extension motion) is prohibited when the hoisting hook 12 is not housed in the hoisting hook receiving section 8*c*, in short, during the crane work.

When the solenoid of the electromagnetic changeover valve 31 is turned on, the electromagnetic changeover valve 31 is switched over to a position opposite to the position shown in FIG. 10, and closes the second pilot circuit 38 communicating the dumping side of the aforementioned bucket command valve 27 and the bucket command section 30. Pilot hydraulic oil in the first pilot circuit 37 communicating the excavation side of the bucket command valve 27 and the bucket command section 30 returns to the oil tank 35 through the electromagnetic changeover valve 31. The pilot pressure does not act on the excavation side of the bucket command valve 27 even when the bucket command section 30 is operated to the excavation side of the bucket command valve 30. Thus, the aforementioned bucket 11 does not move to the excavation side.

In this embodiment also, the hydraulic pressure of the second oil passage 40 connecting the connection port of the bucket command valve 27 and the head side of the bucket cylinder 9 is detected. A pressure sensor 45 similar to the aforementioned second embodiment is provided. The electromagnetic changeover valve 31 has a function to return the bucket command valve 27 in operation automatically to the inactive position shown in FIG. 4 also, when the hydraulic pressure in the second oil passage 40 exceeds a predetermined hydraulic pressure. When the hydraulic pressure in the second oil passage 40 varies, the leak pressure is detected by the pressure sensor 45, and the hydraulic pressure detection signal thereof is output to a not shown controller. The controller compares the detected hydraulic pressure value outputted from the pressure sensor 45 and a predetermined normal hydraulic pressure, and judges whether or not the hydraulic pressure in the second oil passage 40 shows the normal hydraulic pressure value. If the hydraulic pressure in the second oil passage 40 exceeds the predetermined value, the controller emits a changeover signal to the electromagnetic changeover valve 31.

In the hydraulic shovel 1 of this embodiment also, a fall prevention means 20 being characteristic to the present invention and having the same composition as the aforementioned first embodiment is directly fitted to respective cylinders 5, 7, 9. In this embodiment, however, as shown in FIG. 7, the fall prevention means 20 is directly mounted to the bottom side of the main boom cylinder 5, the bottom side and head side of the stick boom cylinder 7, and the head side of the bucket cylinder 9 respectively.

The bottom side of the bucket cylinder 9 and the connection port of the bucket command valve 27 are connected through the first oil passage 39. The second oil passage 40 connecting the head side of the bucket cylinder 9 and the connection port of the bucket command valve 27 connect to the changeover valve 41. The first pressure receiving section 41*a* of the changeover valve 41 is connected to the first pilot circuit 37 connecting the first pressure receiving section 27*a* of the bucket command valve 27 and the excavation side of the aforementioned bucket command section 30 through the electromagnetic changeover valve 31. The second pressure receiving section 41*b* of the changeover valve 41 is connected to the drain circuit 34.

The changeover valve 34 is always maintained at the close position, and is changed over to the open position by the pilot hydraulic oil supplied by operating the bucket command section 30. If the bucket command section 30 is operated to the excavation side when the electromagnetic changeover valve 31 is in inactivated state shown in FIG. 10, the pilot hydraulic pressure acts on the first pressure receiving section 41*a* of the changeover valve 41 through the first pilot circuit 37 connecting with the pilot command section 30 excavation side.

The first pilot circuit 37 connecting with the excavation side of the pilot command section 30, connects the electromagnetic changeover valve 31 prohibiting the excavation motion of the bucket 11 when the hoisting hook 12 is not housed in the hoisting hook receiving section 8*c* of the stick boom 8. The first pressure receiving section 41*a* of the changeover valve 41 connected to the second oil passage 40 communicating with the connection port of the aforementioned bucket command valve 27 is connected to the first pilot circuit 37 communicating with the aforementioned bucket command section 30 (excavation side) through the electromagnetic changeover valve 31, while the second pressure receiving section 41*b* thereof is connected to the drain circuit 34.

If the command lever 36 of the bucket command section 30 is operated to the excavation side when the electromagnetic changeover valve 31 is in inactivated state shown in FIG. 10, the pilot hydraulic pressure acts on the first pressure receiving section 41*a* of the changeover valve 41 and the excavation side of the bucket command valve 27 through the first pilot circuit 37. As mentioned above, if the electromagnetic changeover valve 31 is changed over in response to an erroneous operation of the crane mode switch during the crane work, the first pilot circuit 37 is to be closed. As the result, the pilot pressure does not act on the bucket command valve 27, disabling the operation by the bucket command section 30 at the excavation side.

If the aforementioned bucket command section 30 is operated to the dumping side, pilot hydraulic oil acts on the second pressure receiving section 27*b* of the bucket command valve 27 through the second pilot circuit 38, and changes the bucket command valve 27 to the dumping side. Oil discharge from the aforementioned variable capacity type pump 24 is supplied to the head side of respective bucket cylinder 9 from the connection port of the bucket command valve 27 through the output circuit 33, the second oil passage 40 and the passage 44 passing through the check valve 42. On the other hand, hydraulic oil of the bucket cylinder 9 at the bottom side thereof returns to the oil tank 35 from the first oil passage 39 via the connection port of the bucket command valve 25 through the drain circuit 34.

On the contrary, If the bucket command section 30 is operated to the excavation side, pilot hydraulic oil acts on the first pressure receiving section 27*a* of the bucket command valve 27 and the first pressure receiving section 41*a* of the changeover valve 41 through the first pilot circuit 37, and changes the bucket command valve 27 to the excavation side and respective changeover valve 41 to the open position. Oil discharge from the aforementioned variable capacity type pump 24 is supplied to the bottom side of the bucket cylinder 9 through the first oil passage 39. Meanwhile, hydraulic oil flow of the bucket cylinder 9 at the head side thereof is adjusted by the throttle 41*c* of the changeover valve 41, passes through the second oil passage 40, and returns to the oil tank 35 passing the connection port of the bucket command valve 27 through the drain circuit 34. As the flow of this return oil is adjusted by the throttle 41*c*, it can operate the bucket cylinder 9 at a very low speed.

When the command lever 36 of the bucket command section 30 and the command lever 36 of the stick boom command section 26 are operated in the mutually opposite direction, the bucket cylinder 9 and the stick boom cylinder 7 extend and retract substantially in the same direction. The first oil passage 39 connecting the head side of the stick boom cylinder 7 and the connection port of the stick boom command valve 26 connects the changeover valve 41. The changeover valve 41 is always held in the close position, and changed over to open position by pilot hydraulic pressure supplied by the operation of the stick boom command section 29.

During the crane work, the retention piece 12*c* of the hoisting hook 12 is disengaged from the engagement member 14 attached to the hoisting hook receiving section 8*c* of the stick boom 8, and the hoisting hook 12 housed in the hoisting hook receiving section 8*c* is rotated, and exposed outside from the hoisting hook receiving section 8*c*. At this time, in order to prevent the bucket 11 and the hoisting hook 12 from interfering, it is necessary to retract the bucket cylinder 9 to hold the bucket 11 at its most retracted position to the stick boom back side. When the bucket cylinder 9 is retracted to the maximum, the maximum hold pressure is always generated at the head side of the bucket cylinder 9 by the own weight of the bucket 11. The crane work by the hoisting hook 12 is performed with the bucket 11 scooping face side being directed downward.

During lifting up a load, even if the hydraulic oil hose connected to the head side of the bucket cylinder 9 is broken, the bucket fall prevention valve 20 acts instantaneously, cuts off the head side oil chamber from the exterior oil passage completely, and maintains securely the hold pressure of the cylinder head side; therefore, the bucket 11 is prevented from rotating suddenly downward and the lifted load is also prevented from free fall. Here, the fall prevention valve 20 can be adopted for a hydraulic shovel provided with a wire type hoisting hook wherein for instance the hoisting hook 12 moves up and down by taking out/in a wire introduced in the main boom or stick boom by a winch from the stick boom top pin position by winding the wire around a pulley supported in the main boom or stick boom, in place of the hoisting hook 12 supported by the stick boom top pin 8*a* of the stick boom 8.

On the other hand, during earth and sand excavation or transportation operation, when the stick boom 8 is rotating to the maximum rotation position backward to the equipment 13, even if the hydraulic oil hose connected to the bottom side of the stick boom cylinder 7 is broken and the bottom side hydraulic pressure is lost, the stick boom rotation prevention valve 20 acts instantaneously, cuts off the cylinder bottom side oil chamber from the exterior oil passage completely, and maintains the hold pressure of the bottom side oil chamber. Therefore, the stick boom 8 is prevented from rotating suddenly downward.

If the stick boom fall prevention valve 20 is provided both at the head side and bottom side of the stick boom cylinder 7, cylinder extension direction or retraction direction hold pressure generated by the load of the stick boom 8 and excavated earth and sand or the like is supported instantaneously by the stick boom fall prevention means 20, preventing the stick boom 8 from rotating suddenly downward. Therefore, this embodiment allows to extend the operation range of the stick boom 8 to the forward and backward maximum swing limit position including the vertical posture, and the safety is secured in the extended whole operation range. Consequently, it becomes unnecessary to set the limit of the operation range of the stick boom 8 as in the prior art, and the stick boom 8 can rotate freely within the whole rotation range in the equipment forward side and the equipment backward side including the stick boom vertical posture (symbols A, B shown in FIG. 5) by the operation of the stick boom cylinder 7. Such extension of operation range leads to an effective earth and sand excavation and transport operation.

When excavated earth and sand are transported to the dumping position, the bucket cylinder 9 is extended, and the bucket 11 is maintained at the maximum excavation posture. Similarly as mentioned before, a cylinder retraction direction force is always applied to the bucket 11, and generates a hold pressure at the bottom side of the bucket cylinder 9. As the bucket rotation prevention valve 20 is directly mounted on the bottom side of the cylinder 9, the cylinder extension direction force applied by the own weight of the bucket 11 and excavated earth and sand or the like is supported, and even if the hydraulic oil hose connected to the bottom side oil chamber is broken, the bucket rotation prevention valve 20 maintains the hold pressure of the bottom side oil chamber; therefore, the bucket 11 is prevented from rotating suddenly downward.

At this dumping position, the stick boom cylinder 7 is retracted to rotates the stick boom 8 upwards and, at the same time, the bucket cylinder 9 is retracted to shift the bucket 11 from the maximum excavation posture to the maximum dumping posture. In this dumping posture, as mentioned before, an extension force is always applied to the bucket cylinder 9 and a hold pressure is generated at the head side of the bucket cylinder 9. When the bucket 11 is shifted from the maximum excavation posture to the maximum dumping posture, even if the hydraulic oil hose connected to the head side of the bucket cylinder 9 is broken, the bucket rotation prevention valve 20 functions to close the inside of the cylinder completely, and maintains the hold pressure of the bucket cylinder 9. Therefore, the bucket 11 is prevented securely from rotating suddenly downward, and the work safety can be enhanced.

As the case of the aforementioned stick boom 8, if the bucket fall prevention valve 20 is provided both at the head side and bottom side of the bucket cylinder 9, not only the rotation range of the stick boom 8 can be increased, but also the excavation rotation range of the bucket 11 can be enlarged, and its excavation range can be increased. The extension of the operation range of the stick boom 8 allows to operate the crane in the vicinity of the equipment and to confirm the positional relation of the hoisting hook 12 and the load by watching with eyes, increasing the operation efficiency considerably. In addition, as the crane work range is enlarged, the crane work in a small site can be performed effectively and safely.

FIG. 11 shows schematically a rotation driving mechanism 50 for automatically housing the hoisting hook 12, according to a typical embodiment of the present invention. In the drawing, a first pulley 51 supported by one end of the aforementioned stick boom top pin 8*a*, a second and a third pulleys 52, 53 arranged right and left and supported by the supporting axis 8*g* for swinging vertically at the distal end of the aforementioned main boom 6, are arranged in the stick boom 8. An endless first belt 55 made of a single chain or the like wound around respective first and second pulleys 51, 52 is disposed along the inner wall in the stick boom 8. In the main boom 6, a fourth pulley 54 corresponding to the third pulley 53 is affixed to the support axis 6*a*. A second belt 56 wound around the third and fourth pulleys 53, 54 is disposed along the inner wall in the main boom 6. The fourth pulley 54 is coupled and fixed to a motor 58 through a transmission mechanism 57.

Output signals from not shown position/detection sensor installed in the motor 58, a similarly not shown proximity switch for detecting hook insertion/extraction, a similarly not shown crane mode switches or others arranged in a cab 3*a* are electrically connected to a similarly not shown controller which emits control signals based on electrical output signals. The controller memorizes ON/OFF combination relation of a not shown crane mode switch or proximity switch, or the like. The hoisting hook 12 is housed automatically by rotating or stopping the electric motor 48 based on a command of a control program by inputting these signals.

The rotation driving mechanism 50 with a simple structure having wire wound pulleys 51 to 54 or the motor 58 for rotation driving of the pulleys 51 to 54 or the like can be installed inside the aforementioned main boom 6 or stick boom 8 utilizing the inner space thereof. For the transition from crane work to excavation work, the hoisting hook 12 can be housed smoothly in the hoisting hook receiving section 8*c* by rotating about the stick boom top pin 8*a*, without requiring manual labor.

As it is evident from the foregoing description, according to the present invention, as the rotation prevention valve 20 is directly mounting at the desired cylinder hold pressure generation area of respective cylinders 5, 7, 9, 50, 60 depending on the structure or operation mode of the operation machine, even when the hydraulic shovel is provided with a crane function, the hold pressure always generated in the head side or bottom side of the bucket cylinder 9 or stick boom cylinder 7 by the excavated earth and sand, or the lifted load, or the like can securely be maintained, so even if the hydraulic oil hose connected to the hold pressure generation side of respective cylinder 9, 7 is broken by an external force, respective fall prevention valve 20 acts instantaneously, cuts off the oil chamber of the respective cylinders 9, 7 from the exterior oil passage completely, allowing to extend a sufficient and effective crane work and excavation range for performing the earth and sand excavation and transportation work, and at the same time, enhance the work safety.

The invention is not limited to the specific details and representative embodiments shown and described herein. Accordingly, various technical modifications may be made by those skilled in the art without departing from the spirit or scope of the embodiments.

What is claimed is:

1. A hydraulic shovel, comprising a main boom rising and descending on a revolving frame, a stick boom linked to the distal end of the main boom and swinging in a vertical direction, and a bucket attached to the distal end of the stick boom and swinging similarly in a vertical direction, wherein the main boom, the stick boom and the bucket are respectively operated independently by operation cylinders, stick boom rotation prevention means for preventing the stick boom from free fall by maintaining a bottom side hold pressure is provided on a bottom side of the cylinder for the stick boom, and bucket rotation prevention means for preventing the bucket from free fall by maintaining the bottom side hold pressure when a bucket cylinder is extended is provided at least on the bottom side of the bucket cylinder.

2. A hydraulic shovel according to claim 1, wherein the bucket rotation prevention means for preventing the bucket from free fall by maintaining the head side hold pressure when the bucket cylinder is retracted is provided at least on the head side of the bucket cylinder.

3. A hydraulic shovel according to claim 1, wherein a hoisting hook is rotatably supported between a pair of right and left bucket landcells protruding from the rear wall section of the bucket outwardly.

4. A hydraulic shovel according to claim 1, wherein a hoisting hook is hung from a stick boom top pin for attaching the bucket to a distal end section of the stick boom.

5. A hydraulic shovel according to claim 4, wherein:

a distal end face opposite to the back face of the stick boom comprises a hoisting hook receiving section having an opening and being capable of housing the hoisting hook;

a reinforcement member disposed around a peripheral section of the opening; and an engagement member for engaging a hook section of the hoisting hook by hanging; wherein the stick boom top pin is rotatably supported at a distal end of the stick boom; and a base end of the hoisting hook is supported by the stick boom top pin.

6. A hydraulic shovel according to claim 5, wherein the hoisting hook is linked to a hook rotation driving mechanism for rotating about the stick boom top pin.

* * * * *